US010974501B2

(12) United States Patent
Uematsu et al.

(10) Patent No.: US 10,974,501 B2
(45) **Date of Patent: *Apr. 13, 2021**

(54) LIQUID DISCHARGE APPARATUS AND CIRCUIT SUBSTRATE

(71) Applicant: SEIKO EPSON CORPORATION, Tokyo (JP)

(72) Inventors: Hidekazu Uematsu, Fujimi-machi (JP); Minoru Hasegawa, Suwa (JP)

(73) Assignee: SEIKO EPSON CORPORATION, Tokyo (JP)

( * ) Notice: Subject to any disclaimer, the term of this patent is extended or adjusted under 35 U.S.C. 154(b) by 0 days.

This patent is subject to a terminal disclaimer.

(21) Appl. No.: 16/724,463

(22) Filed: Dec. 23, 2019

(65) Prior Publication Data

US 2020/0198330 A1 Jun. 25, 2020

(30) Foreign Application Priority Data

Dec. 25, 2018 (JP) ..... JP2018-241703

(51) Int. Cl.
*B41J 2/045* (2006.01)

(52) U.S. Cl.
CPC ..... *B41J 2/04541* (2013.01); *B41J 2/04573* (2013.01); *B41J 2/04581* (2013.01); *B41J 2/04588* (2013.01)

(58) Field of Classification Search
CPC .. B41J 2/04541; B41J 2/04543; B41J 2/0459; B41J 2/0457; B41J 2/04573; B41J 2/04581; B41J 2/04588; B41J 2/04593; B41J 2/04596; B41J 2/14; B41J 2/14233; B41J 2002/14491; B41J 25/34
See application file for complete search history.

(56) References Cited

U.S. PATENT DOCUMENTS

| | | | |
|---|---|---|---|
| 9,908,329 | B2 | 3/2018 | Yamada |
| 2017/0266958 | A1 | 9/2017 | Yamada |
| 2018/0345658 | A1 | 12/2018 | Shimono |

FOREIGN PATENT DOCUMENTS

| | | | |
|---|---|---|---|
| JP | 2018-199314 | A | 12/2018 |

*Primary Examiner* — Anh T Vo
(74) *Attorney, Agent, or Firm* — Oliff PLC

(57) ABSTRACT

A liquid discharge apparatus includes a liquid discharge head, a driving signal output circuit that outputs a driving signal, and a circuit substrate that is electrically coupled to the driving signal output circuit and the liquid discharge head. The circuit substrate includes a first surface, a second surface different from the first surface, a first terminal group, and a second terminal group. The first terminal group includes a plurality of first terminals and is provided on the first surface. The second terminal group includes a plurality of second terminals and is provided on the second surface. The number of first terminals which are electrically coupled to the driving signal output circuit and to which the driving signal is input is smaller than the number of second terminals which are electrically coupled to the liquid discharge head and from which the driving signal is output.

8 Claims, 29 Drawing Sheets

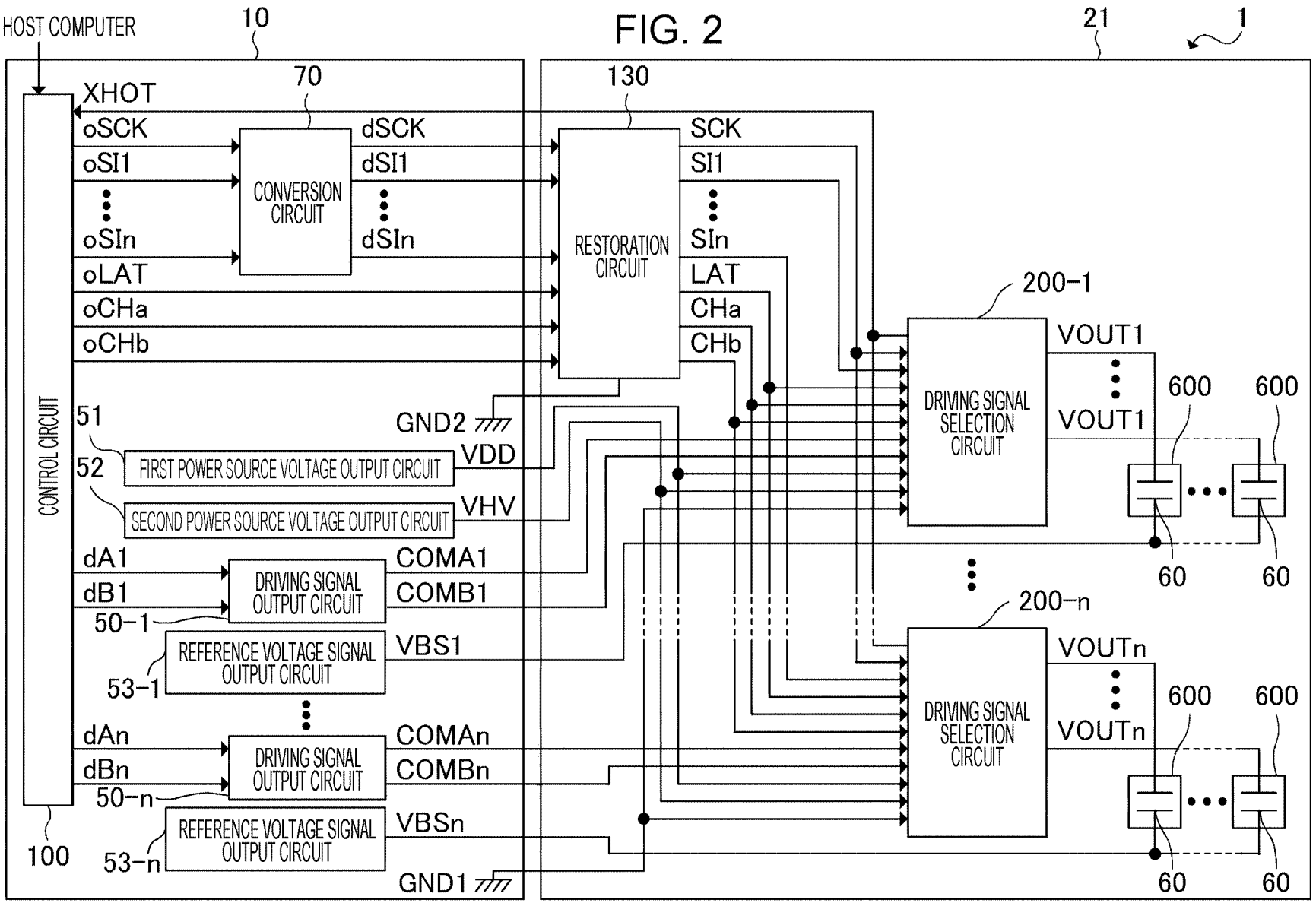
FIG. 2
1
21
10
HOST COMPUTER
XHOT
oSCK
oSI1
oSIn
oLAT
oCHa
oCHb
CONTROL CIRCUIT
100
70
CONVERSION CIRCUIT
dSCK
dSI1
dSIn
130
RESTORATION CIRCUIT
SCK
SI1
SIn
LAT
CHa
CHb
GND2
VDD
VHV
51
FIRST POWER SOURCE VOLTAGE OUTPUT CIRCUIT
52
SECOND POWER SOURCE VOLTAGE OUTPUT CIRCUIT
COMA1
COMB1
dA1
dB1
50-1
DRIVING SIGNAL OUTPUT CIRCUIT
VBS1
53-1
REFERENCE VOLTAGE SIGNAL OUTPUT CIRCUIT
COMAn
COMBn
dAn
dBn
50-n
DRIVING SIGNAL OUTPUT CIRCUIT
VBSn
53-n
REFERENCE VOLTAGE SIGNAL OUTPUT CIRCUIT
GND1
200-1
DRIVING SIGNAL SELECTION CIRCUIT
VOUT1
VOUT1
200-n
DRIVING SIGNAL SELECTION CIRCUIT
VOUTn
VOUTn
600
60

| [SIH, SIL] | | [1, 1] LARGE DOT | [1, 0] MEDIUM DOT | [0, 1] SMALL DOT | [0, 0] NON-RECORDING |
|---|---|---|---|---|---|
| S1 | T1 | H | H | L | L |
| | T2 | H | L | L | L |
| S2 | T3 | L | L | L | H |
| | T4 | L | H | H | L |

FIG. 20

| CABLE 19a1 | | | CONNECTOR 350a1 | SIGNAL |
|---|---|---|---|---|
| TERMINAL NUMBER | WIRING NUMBER | TERMINAL NUMBER | TERMINAL NUMBER | |
| 195a1-1 | 197a1-1 | 196a1-1 | 353a1-1 | VHV |
| 195a1-2 | 197a1-2 | 196a1-2 | 353a1-2 | GND1 |
| 195a1-3 | 197a1-3 | 196a1-3 | 353a1-3 | XHOT |
| 195a1-4 | 197a1-4 | 196a1-4 | 353a1-4 | GND1 |
| 195a1-5 | 197a1-5 | 196a1-5 | 353a1-5 | GND1 |
| 195a1-6 | 197a1-6 | 196a1-6 | 353a1-6 | GND1 |
| 195a1-7 | 197a1-7 | 196a1-7 | 353a1-7 | GND1 |
| 195a1-8 | 197a1-8 | 196a1-8 | 353a1-8 | GND1 |
| 195a1-9 | 197a1-9 | 196a1-9 | 353a1-9 | GND1 |
| 195a1-10 | 197a1-10 | 196a1-10 | 353a1-10 | GND1 |
| 195a1-11 | 197a1-11 | 196a1-11 | 353a1-11 | GND1 |
| 195a1-12 | 197a1-12 | 196a1-12 | 353a1-12 | GND1 |
| 195a1-13 | 197a1-13 | 196a1-13 | 353a1-13 | GND1 |
| 195a1-14 | 197a1-14 | 196a1-14 | 353a1-14 | GND1 |
| 195a1-15 | 197a1-15 | 196a1-15 | 353a1-15 | GND1 |
| 195a1-16 | 197a1-16 | 196a1-16 | 353a1-16 | GND1 |
| 195a1-17 | 197a1-17 | 196a1-17 | 353a1-17 | GND1 |
| 195a1-18 | 197a1-18 | 196a1-18 | 353a1-18 | GND1 |
| 195a1-19 | 197a1-19 | 196a1-19 | 353a1-19 | GND1 |
| 195a1-20 | 197a1-20 | 196a1-20 | 353a1-20 | VDD |
| 195a1-21 | 197a1-21 | 196a1-21 | 353a1-21 | VDD |
| 195a1-22 | 197a1-22 | 196a1-22 | 353a1-22 | VDD |
| 195a1-23 | 197a1-23 | 196a1-23 | 353a1-23 | VDD |
| 195a1-24 | 197a1-24 | 196a1-24 | 353a1-24 | TH |

FIG. 21

| CABLE 19b1 | | | CONNECTOR 350b1 | SIGNAL |
|---|---|---|---|---|
| TERMINAL NUMBER | WIRING NUMBER | TERMINAL NUMBER | TERMINAL NUMBER | |
| 195b1-1 | 197b1-1 | 196b1-1 | 353b1-1 | NVTS |
| 195b1-2 | 197b1-2 | 196b1-2 | 353b1-2 | TSIG |
| 195b1-3 | 197b1-3 | 196b1-3 | 353b1-3 | GND2 |
| 195b1-4 | 197b1-4 | 196b1-4 | 353b1-4 | dSCK+ |
| 195b1-5 | 197b1-5 | 196b1-5 | 353b1-5 | dSCK- |
| 195b1-6 | 197b1-6 | 196b1-6 | 353b1-6 | GND2 |
| 195b1-7 | 197b1-7 | 196b1-7 | 353b1-7 | dSI1+ |
| 195b1-8 | 197b1-8 | 196b1-8 | 353b1-8 | dSI1- |
| 195b1-9 | 197b1-9 | 196b1-9 | 353b1-9 | dSI2+ |
| 195b1-10 | 197b1-10 | 196b1-10 | 353b1-10 | dSI2- |
| 195b1-11 | 197b1-11 | 196b1-11 | 353b1-11 | dSI3+ |
| 195b1-12 | 197b1-12 | 196b1-12 | 353b1-12 | dSI3- |
| 195b1-13 | 197b1-13 | 196b1-13 | 353b1-13 | dSI4+ |
| 195b1-14 | 197b1-14 | 196b1-14 | 353b1-14 | dSI4- |
| 195b1-15 | 197b1-15 | 196b1-15 | 353b1-15 | dSI5+ |
| 195b1-16 | 197b1-16 | 196b1-16 | 353b1-16 | dSI5- |
| 195b1-17 | 197b1-17 | 196b1-17 | 353b1-17 | dSI6+ |
| 195b1-18 | 197b1-18 | 196b1-18 | 353b1-18 | dSI6- |
| 195b1-19 | 197b1-19 | 196b1-19 | 353b1-19 | GND1 |
| 195b1-20 | 197b1-20 | 196b1-20 | 353b1-20 | oLAT |
| 195b1-21 | 197b1-21 | 196b1-21 | 353b1-21 | GND1 |
| 195b1-22 | 197b1-22 | 196b1-22 | 353b1-22 | oCHa |
| 195b1-23 | 197b1-23 | 196b1-23 | 353b1-23 | oCHb |
| 195b1-24 | 197b1-24 | 196b1-24 | 353b1-24 | NCHG |

FIG. 22

| CABLE 19c1 | | | CONNECTOR 350c1 | SIGNAL |
|---|---|---|---|---|
| TERMINAL NUMBER | WIRING NUMBER | TERMINAL NUMBER | TERMINAL NUMBER | |
| 195c1-1 | 197c1-1 | 196c1-1 | 353c1-1 | VBS7 |
| 195c1-2 | 197c1-2 | 196c1-2 | 353c1-2 | COMB7 |
| 195c1-3 | 197c1-3 | 196c1-3 | 353c1-3 | VBS7 |
| 195c1-4 | 197c1-4 | 196c1-4 | 353c1-4 | COMB7 |
| 195c1-5 | 197c1-5 | 196c1-5 | 353c1-5 | VBS8 |
| 195c1-6 | 197c1-6 | 196c1-6 | 353c1-6 | COMA8 |
| 195c1-7 | 197c1-7 | 196c1-7 | 353c1-7 | VBS8 |
| 195c1-8 | 197c1-8 | 196c1-8 | 353c1-8 | COMA8 |
| 195c1-9 | 197c1-9 | 196c1-9 | 353c1-9 | VBS9 |
| 195c1-10 | 197c1-10 | 196c1-10 | 353c1-10 | COMB9 |
| 195c1-11 | 197c1-11 | 196c1-11 | 353c1-11 | VBS9 |
| 195c1-12 | 197c1-12 | 196c1-12 | 353c1-12 | COMB9 |
| 195c1-13 | 197c1-13 | 196c1-13 | 353c1-13 | VBS10 |
| 195c1-14 | 197c1-14 | 196c1-14 | 353c1-14 | COMA10 |
| 195c1-15 | 197c1-15 | 196c1-15 | 353c1-15 | VBS10 |
| 195c1-16 | 197c1-16 | 196c1-16 | 353c1-16 | COMA10 |
| 195c1-17 | 197c1-17 | 196c1-17 | 353c1-17 | VBS11 |
| 195c1-18 | 197c1-18 | 196c1-18 | 353c1-18 | COMB11 |
| 195c1-19 | 197c1-19 | 196c1-19 | 353c1-19 | VBS11 |
| 195c1-20 | 197c1-20 | 196c1-20 | 353c1-20 | COMB11 |
| 195c1-21 | 197c1-21 | 196c1-21 | 353c1-21 | VBS12 |
| 195c1-22 | 197c1-22 | 196c1-22 | 353c1-22 | COMA12 |
| 195c1-23 | 197c1-23 | 196c1-23 | 353c1-23 | VBS12 |
| 195c1-24 | 197c1-24 | 196c1-24 | 353c1-24 | COMA12 |

FIG. 23

| CABLE 19d1 | | | CONNECTOR 350d1 | SIGNAL |
|---|---|---|---|---|
| TERMINAL NUMBER | WIRING NUMBER | TERMINAL NUMBER | TERMINAL NUMBER | |
| 195d1-1 | 197d1-1 | 196d1-1 | 353d1-1 | VBS12 |
| 195d1-2 | 197d1-2 | 196d1-2 | 353d1-2 | COMB12 |
| 195d1-3 | 197d1-3 | 196d1-3 | 353d1-3 | VBS12 |
| 195d1-4 | 197d1-4 | 196d1-4 | 353d1-4 | COMB12 |
| 195d1-5 | 197d1-5 | 196d1-5 | 353d1-5 | VBS11 |
| 195d1-6 | 197d1-6 | 196d1-6 | 353d1-6 | COMA11 |
| 195d1-7 | 197d1-7 | 196d1-7 | 353d1-7 | VBS11 |
| 195d1-8 | 197d1-8 | 196d1-8 | 353d1-8 | COMA11 |
| 195d1-9 | 197d1-9 | 196d1-9 | 353d1-9 | VBS10 |
| 195d1-10 | 197d1-10 | 196d1-10 | 353d1-10 | COMB10 |
| 195d1-11 | 197d1-11 | 196d1-11 | 353d1-11 | VBS10 |
| 195d1-12 | 197d1-12 | 196d1-12 | 353d1-12 | COMB10 |
| 195d1-13 | 197d1-13 | 196d1-13 | 353d1-13 | VBS9 |
| 195d1-14 | 197d1-14 | 196d1-14 | 353d1-14 | COMA9 |
| 195d1-15 | 197d1-15 | 196d1-15 | 353d1-15 | VBS9 |
| 195d1-16 | 197d1-16 | 196d1-16 | 353d1-16 | COMA9 |
| 195d1-17 | 197d1-17 | 196d1-17 | 353d1-17 | VBS8 |
| 195d1-18 | 197d1-18 | 196d1-18 | 353d1-18 | COMB8 |
| 195d1-19 | 197d1-19 | 196d1-19 | 353d1-19 | VBS8 |
| 195d1-20 | 197d1-20 | 196d1-20 | 353d1-20 | COMB8 |
| 195d1-21 | 197d1-21 | 196d1-21 | 353d1-21 | VBS7 |
| 195d1-22 | 197d1-22 | 196d1-22 | 353d1-22 | COMA7 |
| 195d1-23 | 197d1-23 | 196d1-23 | 353d1-23 | VBS7 |
| 195d1-24 | 197d1-24 | 196d1-24 | 353d1-24 | COMA7 |

FIG. 24

| CONNECTOR 370a TERMINAL NUMBER | CONNECTOR 380a TERMINAL NUMBER | SIGNAL |
|---|---|---|
| 373a-1 | 383a-1 | TH |
| 373a-2 | 383a-2 | VDD |
| 373a-3 | 383a-3 | VDD |
| 373a-4 | 383a-4 | VDD |
| 373a-5 | 383a-5 | VDD |
| 373a-6 | 383a-6 | VDD |
| 373a-7 | 383a-7 | VDD |
| 373a-8 | 383a-8 | VDD |
| 373a-9 | 383a-9 | GND1 |
| 373a-10 | 383a-10 | oLAT |
| 373a-11 | 383a-11 | GND1 |
| 373a-12 | 383a-12 | TSIG |
| 373a-13 | 383a-13 | GND2 |
| 373a-14 | 383a-14 | dSI2+ |
| 373a-15 | 383a-15 | dSI2- |
| 373a-16 | 383a-16 | GND2 |
| 373a-17 | 383a-17 | dSI4+ |
| 373a-18 | 383a-18 | dSI4- |
| 373a-19 | 383a-19 | GND2 |
| 373a-20 | 383a-20 | dSI6+ |
| 373a-21 | 383a-21 | dSI6- |
| 373a-22 | 383a-22 | GND2 |
| 373a-23 | 383a-23 | oCHa |
| 373a-24 | 383a-24 | GND1 |
| 373a-25 | 383a-25 | oCHb |
| 373a-26 | 383a-26 | GND1 |
| 373a-27 | 383a-27 | GND1 |
| 373a-28 | 383a-28 | VHV |
| 373a-29 | 383a-29 | VHV |
| 373a-30 | 383a-30 | GND1 |

| CONNECTOR 370a TERMINAL NUMBER | CONNECTOR 380a TERMINAL NUMBER | SIGNAL |
|---|---|---|
| 374a-1 | 384a-1 | VDD |
| 374a-2 | 384a-2 | VDD |
| 374a-3 | 384a-3 | VDD |
| 374a-4 | 384a-4 | VDD |
| 374a-5 | 384a-5 | VDD |
| 374a-6 | 384a-6 | VDD |
| 374a-7 | 384a-7 | VDD |
| 374a-8 | 384a-8 | VDD |
| 374a-9 | 384a-9 | GND2 |
| 374a-10 | 384a-10 | dSCK+ |
| 374a-11 | 384a-11 | dSCK- |
| 374a-12 | 384a-12 | GND2 |
| 374a-13 | 384a-13 | dSI1+ |
| 374a-14 | 384a-14 | dSI1- |
| 374a-15 | 384a-15 | GND2 |
| 374a-16 | 384a-16 | dSI3+ |
| 374a-17 | 384a-17 | dSI3- |
| 374a-18 | 384a-18 | GND2 |
| 374a-19 | 384a-19 | dSI5+ |
| 374a-20 | 384a-20 | dSI5- |
| 374a-21 | 384a-21 | GND2 |
| 374a-22 | 384a-22 | NCHG |
| 374a-23 | 384a-23 | GND1 |
| 374a-24 | 384a-24 | XHOT |
| 374a-25 | 384a-25 | GND1 |
| 374a-26 | 384a-26 | NVTS |
| 374a-27 | 384a-27 | GND1 |
| 374a-28 | 384a-28 | VHV |
| 374a-29 | 384a-29 | VHV |
| 374a-30 | 384a-30 | GND1 |

FIG. 25A

| CONNECTOR 370a TERMINAL NUMBER | CONNECTOR 380a TERMINAL NUMBER | SIGNAL | CONNECTOR 370a TERMINAL NUMBER | CONNECTOR 380a TERMINAL NUMBER | SIGNAL |
|---|---|---|---|---|---|
| 373a-31 | 383a-31 | COMA12 | 374a-31 | 384a-31 | VBS12 |
| 373a-32 | 383a-32 | | 374a-32 | 384a-32 | |
| 373a-33 | 383a-33 | VBS12 | 374a-33 | 384a-33 | COMB12 |
| 373a-34 | 383a-34 | | 374a-34 | 384a-34 | |
| 373a-35 | 383a-35 | COMA12 | 374a-35 | 384a-35 | VBS12 |
| 373a-36 | 383a-36 | | 374a-36 | 384a-36 | |
| 373a-37 | 383a-37 | VBS12 | 374a-37 | 384a-37 | COMB12 |
| 373a-38 | 383a-38 | | 374a-38 | 384a-38 | |
| 373a-39 | 383a-39 | COMB11 | 374a-39 | 384a-39 | VBS11 |
| 373a-40 | 383a-40 | | 374a-40 | 384a-40 | |
| 373a-41 | 383a-41 | VBS11 | 374a-41 | 384a-41 | COMA11 |
| 373a-42 | 383a-42 | | 374a-42 | 384a-42 | |
| 373a-43 | 383a-43 | COMB11 | 374a-43 | 384a-43 | VBS11 |
| 373a-44 | 383a-44 | | 374a-44 | 384a-44 | |
| 373a-45 | 383a-45 | VBS11 | 374a-45 | 384a-45 | COMA11 |
| 373a-46 | 383a-46 | | 374a-46 | 384a-46 | |
| 373a-47 | 383a-47 | COMA10 | 374a-47 | 384a-47 | VBS10 |
| 373a-48 | 383a-48 | | 374a-48 | 384a-48 | |
| 373a-49 | 383a-49 | VBS10 | 374a-49 | 384a-49 | COMB10 |
| 373a-50 | 383a-50 | | 374a-50 | 384a-50 | |
| 373a-51 | 383a-51 | COMA10 | 374a-51 | 384a-51 | VBS10 |
| 373a-52 | 383a-52 | | 374a-52 | 384a-52 | |
| 373a-53 | 383a-53 | VBS10 | 374a-53 | 384a-53 | COMB10 |
| 373a-54 | 383a-54 | | 374a-54 | 384a-54 | |

TO FIG. 25B

FIG. 25B

FROM FIG. 25A

| | | | | | |
|---|---|---|---|---|---|
| 373a-55 | 383a-55 | COMB9 | 374a-55 | 384a-55 | VBS9 |
| 373a-56 | 383a-56 | | 374a-56 | 384a-56 | |
| 373a-57 | 383a-57 | VBS9 | 374a-57 | 384a-57 | COMA9 |
| 373a-58 | 383a-58 | | 374a-58 | 384a-58 | |
| 373a-59 | 383a-59 | COMB9 | 374a-59 | 384a-59 | VBS9 |
| 373a-60 | 383a-60 | | 374a-60 | 384a-60 | |
| 373a-61 | 383a-61 | VBS9 | 374a-61 | 384a-61 | COMA9 |
| 373a-62 | 383a-62 | | 374a-62 | 384a-62 | |
| 373a-63 | 383a-63 | COMA8 | 374a-63 | 384a-63 | V8BS8 |
| 373a-64 | 383a-64 | | 374a-64 | 384a-64 | |
| 373a-65 | 383a-65 | VBS8 | 374a-65 | 384a-65 | COMB8 |
| 373a-66 | 383a-66 | | 374a-66 | 384a-66 | |
| 373a-67 | 383a-67 | COMA8 | 374a-67 | 384a-67 | VBS8 |
| 373a-68 | 383a-68 | | 374a-68 | 384a-68 | |
| 373a-69 | 383a-69 | VBS8 | 374a-69 | 384a-69 | COMB8 |
| 373a-70 | 383a-70 | | 374a-70 | 384a-70 | |
| 373a-71 | 383a-71 | COMB7 | 374a-71 | 384a-71 | VBS7 |
| 373a-72 | 383a-72 | | 374a-72 | 384a-72 | |
| 373a-73 | 383a-73 | VBS7 | 374a-73 | 384a-73 | COMA7 |
| 373a-74 | 383a-74 | | 374a-74 | 384a-74 | |
| 373a-75 | 383a-75 | COMB7 | 374a-75 | 384a-75 | VBS7 |
| 373a-76 | 383a-76 | | 374a-76 | 384a-76 | |
| 373a-77 | 383a-77 | VBS7 | 374a-77 | 384a-77 | COMA7 |
| 373a-78 | 383a-78 | | 374a-78 | 384a-78 | |
| 373a-79 | 383a-79 | GND | 374a-79 | 384a-79 | GND |
| 373a-80 | 383a-80 | TH_LOOP | 374a-80 | 384a-80 | TH_LOOP |

FIG. 26

| CABLE 19a2 | | | CONNECTOR 350a2 | SIGNAL |
|---|---|---|---|---|
| TERMINAL NUMBER | WIRING NUMBER | TERMINAL NUMBER | TERMINAL NUMBER | |
| 195a2-1 | 197a2-1 | 196a2-1 | 353a2-1 | VHV |
| 195a2-2 | 197a2-2 | 196a2-2 | 353a2-2 | GND1 |
| 195a2-3 | 197a2-3 | 196a2-3 | 353a2-3 | XHOT |
| 195a2-4 | 197a2-4 | 196a2-4 | 353a2-4 | GND1 |
| 195a2-5 | 197a2-5 | 196a2-5 | 353a2-5 | GND1 |
| 195a2-6 | 197a2-6 | 196a2-6 | 353a2-6 | GND1 |
| 195a2-7 | 197a2-7 | 196a2-7 | 353a2-7 | GND1 |
| 195a2-8 | 197a2-8 | 196a2-8 | 353a2-8 | GND1 |
| 195a2-9 | 197a2-9 | 196a2-9 | 353a2-9 | GND1 |
| 195a2-10 | 197a2-10 | 196a2-10 | 353a2-10 | GND1 |
| 195a2-11 | 197a2-11 | 196a2-11 | 353a2-11 | GND1 |
| 195a2-12 | 197a2-12 | 196a2-12 | 353a2-12 | GND1 |
| 195a2-13 | 197a2-13 | 196a2-13 | 353a2-13 | GND1 |
| 195a2-14 | 197a2-14 | 196a2-14 | 353a2-14 | GND1 |
| 195a2-15 | 197a2-15 | 196a2-15 | 353a2-15 | GND1 |
| 195a2-16 | 197a2-16 | 196a2-16 | 353a2-16 | GND1 |
| 195a2-17 | 197a2-17 | 196a2-17 | 353a2-17 | GND1 |
| 195a2-18 | 197a2-18 | 196a2-18 | 353a2-18 | GND1 |
| 195a2-19 | 197a2-19 | 196a2-19 | 353a2-19 | GND1 |
| 195a2-20 | 197a2-20 | 196a2-20 | 353a2-20 | VDD |
| 195a2-21 | 197a2-21 | 196a2-21 | 353a2-21 | VDD |
| 195a2-22 | 197a2-22 | 196a2-22 | 353a2-22 | VDD |
| 195a2-23 | 197a2-23 | 196a2-23 | 353a2-23 | VDD |
| 195a2-24 | 197a2-24 | 196a2-24 | 353a2-24 | TH |

FIG. 27

| CABLE 19b2 | | | CONNECTOR 350b2 | SIGNAL |
|---|---|---|---|---|
| TERMINAL NUMBER | WIRING NUMBER | TERMINAL NUMBER | TERMINAL NUMBER | |
| 195b2-1 | 197b2-1 | 196b2-1 | 353b2-1 | NVTS |
| 195b2-2 | 197b2-2 | 196b2-2 | 353b2-2 | TSIG |
| 195b2-3 | 197b2-3 | 196b2-3 | 353b2-3 | GND2 |
| 195b2-4 | 197b2-4 | 196b2-4 | 353b2-4 | dSCK+ |
| 195b2-5 | 197b2-5 | 196b2-5 | 353b2-5 | dSCK- |
| 195b2-6 | 197b2-6 | 196b2-6 | 353b2-6 | GND2 |
| 195b2-7 | 197b2-7 | 196b2-7 | 353b2-7 | dSI7+ |
| 195b2-8 | 197b2-8 | 196b2-8 | 353b2-8 | dSI7- |
| 195b2-9 | 197b2-9 | 196b2-9 | 353b2-9 | dSI8+ |
| 195b2-10 | 197b2-10 | 196b2-10 | 353b2-10 | dSI8- |
| 195b2-11 | 197b2-11 | 196b2-11 | 353b2-11 | dSI9+ |
| 195b2-12 | 197b2-12 | 196b2-12 | 353b2-12 | dSI9- |
| 195b2-13 | 197b2-13 | 196b2-13 | 353b2-13 | dSI10+ |
| 195b2-14 | 197b2-14 | 196b2-14 | 353b2-14 | dSI10- |
| 195b2-15 | 197b2-15 | 196b2-15 | 353b2-15 | dSI11+ |
| 195b2-16 | 197b2-16 | 196b2-16 | 353b2-16 | dSI11- |
| 195b2-17 | 197b2-17 | 196b2-17 | 353b2-17 | dSI12+ |
| 195b2-18 | 197b2-18 | 196b2-18 | 353b2-18 | dSI12- |
| 195b2-19 | 197b2-19 | 196b2-19 | 353b2-19 | GND1 |
| 195b2-20 | 197b2-20 | 196b2-20 | 353b2-20 | oLAT |
| 195b2-21 | 197b2-21 | 196b2-21 | 353b2-21 | GND1 |
| 195b2-22 | 197b2-22 | 196b2-22 | 353b2-22 | oCHa |
| 195b2-23 | 197b2-23 | 196b2-23 | 353b2-23 | oCHb |
| 195b2-24 | 197b2-24 | 196b2-24 | 353b2-24 | NCHG |

FIG. 28

| CABLE 19c2 | | | CONNECTOR 350c2 | SIGNAL |
|---|---|---|---|---|
| TERMINAL NUMBER | WIRING NUMBER | TERMINAL NUMBER | TERMINAL NUMBER | |
| 195c2-1 | 197c2-1 | 196c2-1 | 353c2-1 | VBS1 |
| 195c2-2 | 197c2-2 | 196c2-2 | 353c2-2 | COMB1 |
| 195c2-3 | 197c2-3 | 196c2-3 | 353c2-3 | VBS1 |
| 195c2-4 | 197c2-4 | 196c2-4 | 353c2-4 | COMB1 |
| 195c2-5 | 197c2-5 | 196c2-5 | 353c2-5 | VBS2 |
| 195c2-6 | 197c2-6 | 196c2-6 | 353c2-6 | COMA2 |
| 195c2-7 | 197c2-7 | 196c2-7 | 353c2-7 | VBS2 |
| 195c2-8 | 197c2-8 | 196c2-8 | 353c2-8 | COMA2 |
| 195c2-9 | 197c2-9 | 196c2-9 | 353c2-9 | VBS3 |
| 195c2-10 | 197c2-10 | 196c2-10 | 353c2-10 | COMB3 |
| 195c2-11 | 197c2-11 | 196c2-11 | 353c2-11 | VBS3 |
| 195c2-12 | 197c2-12 | 196c2-12 | 353c2-12 | COMB3 |
| 195c2-13 | 197c2-13 | 196c2-13 | 353c2-13 | VBS4 |
| 195c2-14 | 197c2-14 | 196c2-14 | 353c2-14 | COMA4 |
| 195c2-15 | 197c2-15 | 196c2-15 | 353c2-15 | VBS4 |
| 195c2-16 | 197c2-16 | 196c2-16 | 353c2-16 | COMA4 |
| 195c2-17 | 197c2-17 | 196c2-17 | 353c2-17 | VBS5 |
| 195c2-18 | 197c2-18 | 196c2-18 | 353c2-18 | COMB5 |
| 195c2-19 | 197c2-19 | 196c2-19 | 353c2-19 | VBS5 |
| 195c2-20 | 197c2-20 | 196c2-20 | 353c2-20 | COMB5 |
| 195c2-21 | 197c2-21 | 196c2-21 | 353c2-21 | VBS6 |
| 195c2-22 | 197c2-22 | 196c2-22 | 353c2-22 | COMA6 |
| 195c2-23 | 197c2-23 | 196c2-23 | 353c2-23 | VBS6 |
| 195c2-24 | 197c2-24 | 196c2-24 | 353c2-24 | COMA6 |

FIG. 29

| CABLE 19d2 | | | CONNECTOR 350d2 | SIGNAL |
|---|---|---|---|---|
| TERMINAL NUMBER | WIRING NUMBER | TERMINAL NUMBER | TERMINAL NUMBER | |
| 195d2-1 | 197d2-1 | 196d2-1 | 353d2-1 | VBS6 |
| 195d2-2 | 197d2-2 | 196d2-2 | 353d2-2 | COMB6 |
| 195d2-3 | 197d2-3 | 196d2-3 | 353d2-3 | VBS6 |
| 195d2-4 | 197d2-4 | 196d2-4 | 353d2-4 | COMB6 |
| 195d2-5 | 197d2-5 | 196d2-5 | 353d2-5 | VBS5 |
| 195d2-6 | 197d2-6 | 196d2-6 | 353d2-6 | COMA5 |
| 195d2-7 | 197d2-7 | 196d2-7 | 353d2-7 | VBS5 |
| 195d2-8 | 197d2-8 | 196d2-8 | 353d2-8 | COMA5 |
| 195d2-9 | 197d2-9 | 196d2-9 | 353d2-9 | VBS4 |
| 195d2-10 | 197d2-10 | 196d2-10 | 353d2-10 | COMB4 |
| 195d2-11 | 197d2-11 | 196d2-11 | 353d2-11 | VBS4 |
| 195d2-12 | 197d2-12 | 196d2-12 | 353d2-12 | COMB4 |
| 195d2-13 | 197d2-13 | 196d2-13 | 353d2-13 | VBS3 |
| 195d2-14 | 197d2-14 | 196d2-14 | 353d2-14 | COMA3 |
| 195d2-15 | 197d2-15 | 196d2-15 | 353d2-15 | VBS3 |
| 195d2-16 | 197d2-16 | 196d2-16 | 353d2-16 | COMA3 |
| 195d2-17 | 197d2-17 | 196d2-17 | 353d2-17 | VBS2 |
| 195d2-18 | 197d2-18 | 196d2-18 | 353d2-18 | COMB2 |
| 195d2-19 | 197d2-19 | 196d2-19 | 353d2-19 | VBS2 |
| 195d2-20 | 197d2-20 | 196d2-20 | 353d2-20 | COMB2 |
| 195d2-21 | 197d2-21 | 196d2-21 | 353d2-21 | VBS1 |
| 195d2-22 | 197d2-22 | 196d2-22 | 353d2-22 | COMA1 |
| 195d2-23 | 197d2-23 | 196d2-23 | 353d2-23 | VBS1 |
| 195d2-24 | 197d2-24 | 196d2-24 | 353d2-24 | COMA1 |

FIG.30

| CONNECTOR 370b TERMINAL NUMBER | CONNECTOR 380b TERMINAL NUMBER | SIGNAL |
|---|---|---|
| 373b-1 | 383b-1 | TH |
| 373b-2 | 383b-2 | VDD |
| 373b-3 | 383b-3 | VDD |
| 373b-4 | 383b-4 | VDD |
| 373b-5 | 383b-5 | VDD |
| 373b-6 | 383b-6 | VDD |
| 373b-7 | 383b-7 | VDD |
| 373b-8 | 383b-8 | VDD |
| 373b-9 | 383b-9 | GND1 |
| 373b-10 | 383b-10 | oLAT |
| 373b-11 | 383b-11 | GND1 |
| 373b-12 | 383b-12 | TSIG |
| 373b-13 | 383b-13 | GND2 |
| 373b-14 | 383b-14 | dSI8+ |
| 373b-15 | 383b-15 | dSI8- |
| 373b-16 | 383b-16 | GND2 |
| 373b-17 | 383b-17 | dSI10+ |
| 373b-18 | 383b-18 | dSI10- |
| 373b-19 | 383b-19 | GND2 |
| 373b-20 | 383b-20 | dSI12+ |
| 373b-21 | 383b-21 | dSI12- |
| 373b-22 | 383b-22 | GND2 |
| 373b-23 | 383b-23 | oCHa |
| 373b-24 | 383b-24 | GND1 |
| 373b-25 | 383b-25 | oCHb |
| 373b-26 | 383b-26 | GND1 |
| 373b-27 | 383b-27 | GND1 |
| 373b-28 | 383b-28 | VHV |
| 373b-29 | 383b-29 | VHV |
| 373b-30 | 383b-30 | GND1 |

| CONNECTOR 370b TERMINAL NUMBER | CONNECTOR 380b TERMINAL NUMBER | SIGNAL |
|---|---|---|
| 374b-1 | 384b-1 | VDD |
| 374b-2 | 384b-2 | VDD |
| 374b-3 | 384b-3 | VDD |
| 374b-4 | 384b-4 | VDD |
| 374b-5 | 384b-5 | VDD |
| 374b-6 | 384b-6 | VDD |
| 374b-7 | 384b-7 | VDD |
| 374b-8 | 384b-8 | VDD |
| 374b-9 | 384b-9 | GND2 |
| 374b-10 | 384b-10 | dSCK+ |
| 374b-11 | 384b-11 | dSCK- |
| 374b-12 | 384b-12 | GND2 |
| 374b-13 | 384b-13 | dSI7+ |
| 374b-14 | 384b-14 | dSI7- |
| 374b-15 | 384b-15 | GND2 |
| 374b-16 | 384b-16 | dSI9+ |
| 374b-17 | 384b-17 | dSI9- |
| 374b-18 | 384b-18 | GND2 |
| 374b-19 | 384b-19 | dSI11+ |
| 374b-20 | 384b-20 | dSI11- |
| 374b-21 | 384b-21 | GND2 |
| 374b-22 | 384b-22 | NCHG |
| 374b-23 | 384b-23 | GND1 |
| 374b-24 | 384b-24 | XHOT |
| 374b-25 | 384b-25 | GND1 |
| 374b-26 | 384b-26 | NVTS |
| 374b-27 | 384b-27 | GND1 |
| 374b-28 | 384b-28 | VHV |
| 374b-29 | 384b-29 | VHV |
| 374b-30 | 384b-30 | GND1 |

FIG. 31A

| CONNECTOR 370b TERMINAL NUMBER | CONNECTOR 380b TERMINAL NUMBER | SIGNAL | CONNECTOR 370b TERMINAL NUMBER | CONNECTOR 380b TERMINAL NUMBER | SIGNAL |
|---|---|---|---|---|---|
| 373b-31 | 383b-31 | COMA6 | 374b-31 | 384b-31 | VBS6 |
| 373b-32 | 383b-32 | | 374b-32 | 384b-32 | |
| 373b-33 | 383b-33 | VBS6 | 374b-33 | 384b-33 | COMB6 |
| 373b-34 | 383b-34 | | 374b-34 | 384b-34 | |
| 373b-35 | 383b-35 | COMA6 | 374b-35 | 384b-35 | VBS6 |
| 373b-36 | 383b-36 | | 374b-36 | 384b-36 | |
| 373b-37 | 383b-37 | VBS6 | 374b-37 | 384b-37 | COMB6 |
| 373b-38 | 383b-38 | | 374b-38 | 384b-38 | |
| 373b-39 | 383b-39 | COMB5 | 374b-39 | 384b-39 | VBS5 |
| 373b-40 | 383b-40 | | 374b-40 | 384b-40 | |
| 373b-41 | 383b-41 | VBS5 | 374b-41 | 384b-41 | COMA5 |
| 373b-42 | 383b-42 | | 374b-42 | 384b-42 | |
| 373b-43 | 383b-43 | COMB5 | 374b-43 | 384b-43 | VBS5 |
| 373b-44 | 383b-44 | | 374b-44 | 384b-44 | |
| 373b-45 | 383b-45 | VBS5 | 374b-45 | 384b-45 | COMA5 |
| 373b-46 | 383b-46 | | 374b-46 | 384b-46 | |
| 373b-47 | 383b-47 | COMA4 | 374b-47 | 384b-47 | V4BS4 |
| 373b-48 | 383b-48 | | 374b-48 | 384b-48 | |
| 373b-49 | 383b-49 | VBS4 | 374b-49 | 384b-49 | COMB4 |
| 373b-50 | 383b-50 | | 374b-50 | 384b-50 | |
| 373b-51 | 383b-51 | COMA4 | 374b-51 | 384b-51 | VBS4 |
| 373b-52 | 383b-52 | | 374b-52 | 384b-52 | |
| 373b-53 | 383b-53 | VBS4 | 374b-53 | 384b-53 | COMB4 |
| 373b-54 | 383b-54 | | 374b-54 | 384b-54 | |

TO FIG. 31B

FIG. 31B

FROM FIG. 31A

| | | | | | |
|---|---|---|---|---|---|
| 373b-55 | 383b-55 | COMB3 | 374b-55 | 384b-55 | VBS3 |
| 373b-56 | 383b-56 | | 374b-56 | 384b-56 | |
| 373b-57 | 383b-57 | VBS3 | 374b-57 | 384b-57 | COMA3 |
| 373b-58 | 383b-58 | | 374b-58 | 384b-58 | |
| 373b-59 | 383b-59 | COMB3 | 374b-59 | 384b-59 | VBS3 |
| 373b-60 | 383b-60 | | 374b-60 | 384b-60 | |
| 373b-61 | 383b-61 | VBS3 | 374b-61 | 384b-61 | COMA3 |
| 373b-62 | 383b-62 | | 374b-62 | 384b-62 | |
| 373b-63 | 383b-63 | COMA2 | 374b-63 | 384b-63 | VBS2 |
| 373b-64 | 383b-64 | | 374b-64 | 384b-64 | |
| 373b-65 | 383b-65 | VBS2 | 374b-65 | 384b-65 | COMB2 |
| 373b-66 | 383b-66 | | 374b-66 | 384b-66 | |
| 373b-67 | 383b-67 | COMA2 | 374b-67 | 384b-67 | VBS2 |
| 373b-68 | 383b-68 | | 374b-68 | 384b-68 | |
| 373b-69 | 383b-69 | VBS2 | 374b-69 | 384b-69 | COMB2 |
| 373b-70 | 383b-70 | | 374b-70 | 384b-70 | |
| 373b-71 | 383b-71 | COMB1 | 374b-71 | 384b-71 | VBS1 |
| 373b-72 | 383b-72 | | 374b-72 | 384b-72 | |
| 373b-73 | 383b-73 | VBS1 | 374b-73 | 384b-73 | COMA1 |
| 373b-74 | 383b-74 | | 374b-74 | 384b-74 | |
| 373b-75 | 383b-75 | COMB1 | 374b-75 | 384b-75 | VBS1 |
| 373b-76 | 383b-76 | | 374b-76 | 384b-76 | |
| 373b-77 | 383b-77 | VBS1 | 374b-77 | 384b-77 | COMA1 |
| 373b-78 | 383b-78 | | 374b-78 | 384b-78 | |
| 373b-79 | 383b-79 | GND1 | 374b-79 | 384b-79 | GND1 |
| 373b-80 | 383b-80 | TH_LOOP | 374b-80 | 384b-80 | TH_LOOP |

LIQUID DISCHARGE APPARATUS AND CIRCUIT SUBSTRATE

The present application is based on, and claims priority from JP Application Serial Number 2018-241703, filed Dec. 25, 2018, the disclosure of which is hereby incorporated by reference herein in its entirety.

BACKGROUND

1. Technical Field

The present disclosure relates to a liquid discharge apparatus and a circuit substrate.

2. Related Art

It is known that, for example, a piezoelectric element is used for an ink jet printer (liquid discharge apparatus) that prints an image or a document by discharging a liquid such as an ink. The piezoelectric element is provided to correspond to each of a plurality of nozzles in the print head (liquid discharge head). Each of the piezoelectric elements is driven in accordance with a driving signal, and thereby a predetermined amount of liquid is discharged from the nozzle at a predetermined timing to form a dot on a medium. In such a liquid discharge apparatus, the driving signal to be supplied to the liquid discharge head is supplied from various control circuits that generate driving signals, through a plurality of cables.

JP-A-2018-199314 discloses a technology of improving exchangeability of a liquid discharge head by coupling the liquid discharge head to various control circuits including driving signals through a plurality of cables and BtoB connectors in a liquid discharge apparatus.

However, the number of nozzles in the print head increases with a request for higher speed and higher definition of printing in the recent liquid discharge apparatus. Therefore, it is required to more reduce a concern that the waveform of a driving signal for driving the piezoelectric element in the print head are distorted.

SUMMARY

According to an aspect of the present disclosure, a liquid discharge apparatus includes a liquid discharge head that includes a driving element that drives by supplying a driving signal and discharges a liquid from a nozzle by driving of the driving element, a driving signal output circuit that outputs the driving signal, and a circuit substrate that is electrically coupled to the driving signal output circuit and the liquid discharge head and relays propagation of a plurality of control signals including the driving signal to the liquid discharge head. The circuit substrate includes a first surface, a second surface different from the first surface, a first terminal group, and a second terminal group. The first terminal group includes a plurality of first terminals and is provided on the first surface. The second terminal group includes a plurality of second terminals and is provided on the second surface. The number of the first terminals which are electrically coupled to the driving signal output circuit and to which the driving signal is input is smaller than the number of the second terminals which are electrically coupled to the liquid discharge head and from which the driving signal is output.

In the liquid discharge apparatus, the driving signal may supplied to one end of the driving element, and a reference voltage signal may supplied to the other end of the driving element. The liquid discharge apparatus may further include a reference voltage signal output circuit that outputs the reference voltage signal. The circuit substrate may be electrically coupled to the reference voltage signal output circuit and relay propagation of the reference voltage signal as the plurality of control signals to the liquid discharge head. The number of the first terminals which are electrically coupled to the reference voltage signal output circuit and to which the reference voltage signal is input may be smaller than the number of the second terminals which are electrically coupled to the liquid discharge head and from which the reference voltage signal is output.

In the liquid discharge apparatus, the liquid discharge head may include a driving signal selection circuit that includes a switch circuit and controls a supply of the driving signal to the driving element by an operation of the switch circuit. A first power source voltage output circuit that outputs a first voltage signal to be used as a power source voltage of the driving signal selection circuit may be provided. The circuit substrate may be electrically coupled to the first power source voltage output circuit and relay propagation of the first voltage signal as the plurality of control signals to the liquid discharge head. The number of the first terminals which are electrically coupled to the first power source voltage output circuit and to which the first voltage signal is input may be smaller than the number of the second terminals which are electrically coupled to the liquid discharge head and from which the first voltage signal is output.

The liquid discharge apparatus may further include a second power source voltage output circuit that outputs a second voltage signal to be used as an operation voltage for operating the switch circuit. The circuit substrate may be electrically coupled to the second power source voltage output circuit and relay propagation of the second voltage signal as the plurality of control signals to the liquid discharge head. A voltage value of the second voltage signal may be larger than a voltage value of the first voltage signal. The number of the first terminals which are electrically coupled to the second power source voltage output circuit and to which the second voltage signal is input may be smaller than the number of the second terminals which are electrically coupled to the liquid discharge head and from which the second voltage signal is output. A difference between the number of the first terminals to which the second voltage signal is input and the number of the second terminals from which the second voltage signal is output may be smaller than a difference between the number of the first terminals to which the first voltage signal is input and the number of the second terminals from which the first voltage signal is output.

In the liquid discharge apparatus, the number of the plurality of the first terminals included in the first terminal group may be smaller than the number of the plurality of the second terminals included in the second terminal group.

In the liquid discharge apparatus, the first terminal group may include a first connector and a second connector.

In the liquid discharge apparatus, a shortest distance between the plurality of the second terminals may be shorter than a shortest distance between the plurality of the first terminals.

According to another aspect of the present disclosure, a circuit substrate includes a driving element that drives by supplying a driving signal, is electrically coupled to a liquid discharge head that discharges a liquid from a nozzle by driving the driving element and a driving signal output circuit that outputs the driving signal, and relays propagation of a plurality of control signals including the driving signal to the liquid discharge head. The circuit substrate includes a first surface, a second surface different from the first surface, a first terminal group, and a second terminal group. The first terminal group includes a plurality of first terminals and is provided on the first surface. The second terminal group includes a plurality of second terminals and is provided on the second surface. The number of the first terminals which are electrically coupled to the driving signal output circuit and to which the driving signal is input is smaller than the number of the second terminals which are electrically coupled to the liquid discharge head and from which the driving signal is output.

BRIEF DESCRIPTION OF THE DRAWINGS

FIG. 2 is a block diagram illustrating an electrical configuration of the liquid discharge apparatus.

FIG. 20 is a diagram illustrating details of a signal which is propagated in a cable 19*a*1 and is input to a relay substrate 330*a* through a connector 350*a*1.

FIG. 21 is a diagram illustrating details of a signal which is propagated in a cable 19*b*1 and is input to the relay substrate 330*a* through a connector 350*b*1.

FIG. 22 is a diagram illustrating details of a signal which is propagated in a cable 19*c*1 and is input to the relay substrate 330*a* through a connector 350*c*1.

FIG. 23 is a diagram illustrating details of a signal which is propagated in a cable 19*d*1 and is input to the relay substrate 330*a* through a connector 350*d*1.

FIG. 24 is diagram illustrating details of a low-voltage signal and a power source voltage signal among signals output to the liquid discharge head through connectors 370*a* and 380*a*.

FIG. 25 is diagram illustrating details of a signal supplied to a piezoelectric element among signals output to the liquid discharge head through the connectors 370*a* and 380*a*.

FIG. 26 is a diagram illustrating details of a signal which is propagated in a cable 19*a*2 and is input to a relay substrate 330*b* through a connector 350*a*2.

FIG. 27 is a diagram illustrating details of a signal which is propagated in a cable 19*b*2 and is input to the relay substrate 330*b* through a connector 350*b*2.

FIG. 28 is a diagram illustrating details of a signal which is propagated in a cable 19*c*2 and is input to the relay substrate 330*b* through a connector 350*c*2.

FIG. 29 is a diagram illustrating details of a signal which is propagated in a cable 19*d*2 and is input to the relay substrate 330*b* through a connector 350*d*2.

FIG. 30 is a diagram illustrating details of the low-voltage signal and the power source voltage signal among the signals output to the liquid discharge head through connectors 370*b* and 380*b*.

FIG. 31 is a diagram illustrating details of a signal supplied to the piezoelectric element among the signals output to the liquid discharge head through the connectors 370*b* and 380*b*.

DESCRIPTION OF EXEMPLARY EMBODIMENTS

Hereinafter, preferred embodiments of the present disclosure will be described with reference to the drawings. The drawings are used for easy descriptions. The embodiments described below do not limit the scope of the present disclosure described in the claims. All components described later are not necessarily essential constituent elements of the present disclosure.

1. Outline of Liquid Discharge Apparatus

Figure 1:
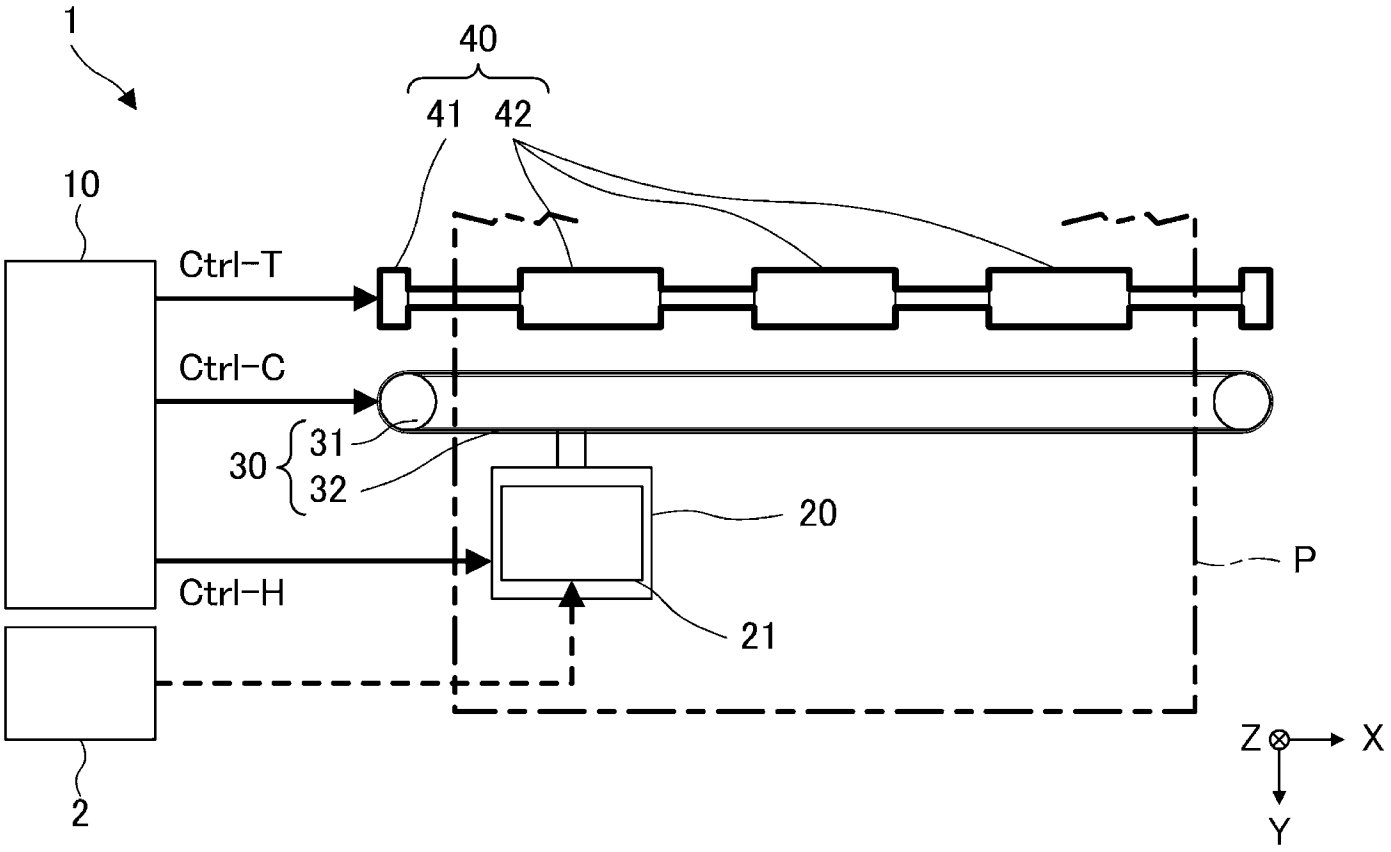
FIG. 1 is a diagram illustrating an overall configuration of a liquid discharge apparatus.

FIG. 1 is a diagram illustrating an overall configuration of a liquid discharge apparatus 1. The liquid discharge apparatus 1 is a serial printing type ink jet printer that forms an image on a medium P in a manner that a carriage 20 discharges an ink to the transported medium P with reciprocating. In the carriage 20, a liquid discharge head 21 that discharges the ink as an example of a liquid is mounted. In the following descriptions, descriptions will be made on the assumption that a direction in which the carriage 20 moves is an X-direction, a direction in which the medium P is transported is a Y-direction, and a direction in which the ink is discharged is a Z-direction. Descriptions will be made on the assumption that the X-direction, the Y-direction, and the Z-direction are perpendicular to each other. However, the descriptions are not limited to a point that various components in the liquid discharge apparatus 1 are disposed to be perpendicular to each other. As the medium P, any printing target such as print paper, a resin film, and a cloth can be used.

The liquid discharge apparatus 1 includes a liquid container 2, a control mechanism 10, the carriage 20, a movement mechanism 30, and a transport mechanism 40.

Plural kinds of inks to be discharged onto a medium P are stored in the liquid container 2. As the color of the ink stored in the liquid container 2, black, cyan, magenta, yellow, red, and gray, and the like are exemplified. As the liquid container 2 in which such an ink is stored, an ink cartridge, a bag-like ink pack formed of a flexible film, an ink tank capable of replenishing an ink, or the like is used.

The control mechanism 10 includes, for example, a processing circuit such as a central processing unit (CPU) or a field programmable gate array (FPGA) and a storage circuit such as a semiconductor memory. The control mechanism 10 controls elements of the liquid discharge apparatus 1. Specifically, the control mechanism 10 generates control signals Ctrl-H, Ctrl-C, and Ctrl-T for controlling operations of various components of the liquid discharge apparatus 1, and outputs the control signals to the corresponding components.

The liquid discharge head 21 is mounted in the carriage 20. The control signal Ctrl-H including a plurality of signals is input to the liquid discharge head 21. The liquid discharge head 21 discharges an ink supplied from the liquid container 2, based on the control signal Ctrl-H. The liquid container 2 may be mounted in the carriage 20.

The movement mechanism 30 includes a carriage motor 31 and an endless belt 32. The control signal Ctrl-C is input to the movement mechanism 30. The carriage motor 31 operates based on the control signal Ctrl-C. The carriage 20 is fixed to the endless belt 32. The endless belt 32 rotates by an operation of the carriage motor 31. Thus, the carriage 20 fixed to the endless belt 32 reciprocates in the X-direction. The control signal Ctrl-C may be converted into a signal having a more suitable format for operating the carriage motor 31 in a carriage motor driver (not illustrated).

The transport mechanism 40 includes a transport motor 41 and a transport roller 42. The control signal Ctrl-T is input to the transport mechanism 40. The transport motor 41 operates based on the control signal Ctrl-T. The transport roller 42 rotates by an operation of the transport motor 41. A medium P is transported in the Y-direction with the rotation of the transport roller 42. The control signal Ctrl-T may be converted into a signal having a more suitable format for operating the transport motor 41 in a transport motor driver (not illustrated).

As described above, the liquid discharge apparatus 1 discharges an ink from the liquid discharge head 21 mounted in the carriage 20 in the Z-direction with transport of the medium P in the Y-direction by the transport mechanism 40 and reciprocation of the carriage 20 in the X-direction by the movement mechanism 30. Thus, the liquid discharge apparatus 1 forms a desired image on the medium P.

2. Electrical Configuration of Liquid Discharge Apparatus

FIG. 2 is a block diagram illustrating an electrical configuration of the liquid discharge apparatus 1. The liquid discharge apparatus 1 includes the control mechanism 10 and the liquid discharge head 21. Descriptions will be made on the assumption that the liquid discharge head 21 in FIG. 2 includes n driving signal selection circuits 200.

The control mechanism 10 includes a conversion circuit 70, driving signal output circuits 50-1 to **50-*n*, reference voltage signal output circuits 53-1 to 53-*n*, a first power source voltage output circuit 51, a second power source voltage output circuit 52, and a control circuit 100. The control circuit 100 includes a processor such as a microcontroller, for example. The control circuit 100 generates and outputs data or various signals for controlling the liquid discharge apparatus 1**, based on various signals such as image data, which are input from a host computer.

Specifically, the control circuit 100 outputs a base clock signal oSCK, base print data signals oSI1 to oSIn, a base latch signal oLAT, base change signals oCHa and oCHb, and base driving signals dA1 to dAn and dB1 to dBn, which are used for controlling the liquid discharge apparatus 1.

The base clock signal oSCK, the base print data signals oSI1 to oSIn, the base latch signal oLAT, and the base change signals oCHa and oCHb are signals being bases of a clock signal SCK, print data signals SI1 to SIn, a latch signal LAT, and change signals CHa and CHb which are for controlling an operation of the liquid discharge head 21. The control circuit 100 outputs the base clock signal oSCK and each of the base print data signals oSI1 to oSIn to the conversion circuit 70. The control circuit 100 outputs the base latch signal oLAT and each of the base change signals oCHa and oCHb to the liquid discharge head 21, The conversion circuit 70 converts each of the input base clock signal oSCK and base print data signals oSI1 to oSIn into pairs of differential signals. Specifically, the conversion circuit 70 converts the base clock signal oSCK being the base of the clock signal SCK into a pair of differential clock signals dSCK. The conversion circuit 70 converts each of the base print data signals oSI1 to oSIn being each of the bases of the print data signals SI1 to SIn into pairs of differential print data signals dSI1 to dSIn. The conversion circuit 70 outputs the differential clock signal dSCK and each of the differential print data signals dSI1 to dSIn to the liquid discharge head 21.

Here, the conversion circuit 70 performs conversion into a differential signal of a low voltage differential signaling (LVDS) transfer method, for example. A differential signal of the LVDS transfer method has an amplitude of substantially 350 mV, and thus can realize high-speed data transfer. The conversion circuit 70 may perform conversion into a differential signal of various high-speed transfer method such as a low voltage positive emitter coupled logic (LVPECL) transfer method or a current mode logic (CML) transfer method in addition to the LVDS transfer method.

The base driving signals dA1 to dAn and dB1 to dBn are digital signals and signals being bases of driving signals COMA1 to COMAn and COMB1 to COMBn for driving a piezoelectric element 60 as a driving element provided in the liquid discharge head 21. The base driving signals dA1 to dAn and dB1 to dBn are input to the corresponding driving signal output circuits 50-1 to **50-*n*, respectively. The following descriptions will be made on the assumption that the base driving signals dAi and dBi (i is any of 1 to n) are input to the corresponding driving signal output circuit 50-*i***.

The driving signal output circuit **50-*i* generates the driving signal COMAi by performing D-class amplification on an analog signal obtained by performing digital-to-analog signal conversion on the input base driving signal dAi. The driving signal output circuit 50-*i* generates the driving signal COMBi by performing D-class amplification on an analog signal obtained by performing digital-to-analog signal conversion on the input base driving signal dBi. That is, the driving signal output circuit 50-*i* includes two D-class amplifier circuits which are a D-class amplifier circuit that generates the driving signal COMAi based on the base driving signal dAi and a D-class amplifier circuit that generates the driving signal COMBi based on the base driving signal dBi. The base driving signals dAi and dBi may be signals capable of defining waveforms of the driving signals COMAi and COMBi and may be analog signals. The two D-class amplifier circuit in the driving signal output circuit 50-*i*** may be capable of amplifying the waveform defined by the base driving signals dAi and dBi, and may be configured with various amplifier circuits such as an A-class amplifier circuit, a B-class amplifier circuit, or an AB-class amplifier circuit.

The reference voltage signal output circuits 53-1 to **53-*n* generate voltages VBS1 to VBSn indicating reference potentials of the driving signals COMA1 to COMAn and COMB1 to COMBn. For example, each of the voltage VBS1 to VBSn may be a signal having a ground potential in which a voltage value is 0 V, or may be a signal having a DC voltage in which a voltage value is 5 V, 6 V, or the like. Here, descriptions will be made on the assumption that the reference voltage signal output circuit 53**-*i* generates the voltage VBSi having a reference potential corresponding to the driving signals COMAi and COMBi output by the driving signal output circuit 50-*i*. Here, the voltage VBSi is an example of a reference voltage signal.

The driving signal output circuit 50-*i* outputs the generated driving signals COMAi and COMBi to the liquid discharge head 21. The reference voltage signal output circuit 53-*i* outputs the generated voltage VBSi to the liquid discharge head 21. All of the driving signal output circuits 50-1 to 50-*n* have the similar configuration, and thus may be referred to as a driving signal output circuit 50 in the following descriptions. Descriptions may be made on the assumption that the base driving signals dA and dB are input to the driving signal output circuit 50, and the driving signal output circuit 50 generates the driving signals COMA and COMB. Signal, any reference voltage signal output circuit 53-*i* has the similar configuration, and thus descriptions will be made on the assumption that the reference voltage signal output circuit 53-*i* is referred to as a reference voltage signal output circuit 53, and the reference voltage signal output circuit 53 generates the voltage VBS.

Here, although not illustrated in FIG. 2, the control circuit 100 outputs the control signal Ctrl-C for controlling reciprocation of the carriage 20 (in which the liquid discharge head 21 is mounted) in the X-direction to the movement mechanism 30 illustrated in FIG. 1. The control circuit 100 outputs the control signal Ctrl-T for controlling transport of the medium P in the Y-direction to the transport mechanism 40 illustrated in FIG. 1.

The first power source voltage output circuit 51 outputs a voltage VDD to be used as a power source voltage of driving signal selection circuits 200-1 to 200-*n* described later. Specifically, the first power source voltage output circuit 51 generates the voltage VDD being a DC voltage having a voltage value of 3.3 V, for example. The voltage VDD is a power source voltage for various components included in the control mechanism 10 and the liquid discharge head 21. The first power source voltage output circuit 51 may generate voltage VDD having a plurality of voltage values suitable for the various components of the control mechanism 10 and the liquid discharge head 21. The first power source voltage output circuit 51 outputs the generated voltages VDD to the various components including the liquid discharge head 21. Here, the voltage VDD is an example of a first voltage signal.

The second power source voltage output circuit 52 outputs a voltage VHV to be used as an operation voltage for operating the selection circuit 230 in the driving signal selection circuits 200-1 to 200-*n* described later. The voltage value of the voltage VHV is larger than the voltage value of the voltage VDD and is a DC voltage having a voltage value of 42 V, for example. The voltage VHV is supplied to the driving signal output circuits 50-1 to 50-*n* in addition to the selection circuit 230. The driving signal output circuits 50-1 to 50-*n* generate the driving signals COMA1 to COMAn and COMB1 to COMBn subjected to D-class amplification, based on the voltage VHV. Here, the voltage VHV is an example of a second voltage signal.

As described above, the control mechanism 10 outputs the above-described various signals and voltages to the liquid discharge head 21 as the control signal Ctrl-H for controlling the operation of the liquid discharge head 21. The control mechanism 10 outputs ground signals GND1 and GND2 for defining a ground potential of the liquid discharge head 21 to the liquid discharge head 21.

The liquid discharge head 21 includes a restoration circuit 130, the driving signal selection circuits 200-1 to 200-*n*, and a plurality of discharge sections 600.

The differential clock signal dSCK, the differential print data signals dSI1 to dSIn, the base latch signal oLAT, and the base change signals oCHa and oCHb are input to the restoration circuit 130. The restoration circuit 130 restores the differential signal to a single-ended signal based on the input various signals.

Specifically, the restoration circuit 130 restores the differential clock signal dSCK and the differential print data signals dSI1 to dSIn to single-ended signals based on the input base latch signal oLAT and a timing defined by the base change signals oCHa and oCHb. In other words, the restoration circuit 130 restores a pair of differential clock signals dSCK to the clock signal SCK. The restoration circuit 130 restores the pair of differential print data signals dSI1 to dSIn to the print data signals SI1 to SIn, respectively. The restoration circuit 130 outputs the clock signal SCK and the print data signals SI1 to SIn being the restored single-ended signals.

The base latch signal oLAT and the base change signals oCHa and oCHb input to the restoration circuit 130 are used for defining a timing for restoring the pair of differential signals to a single-ended signal, and then are output from the restoration circuit 130 as the latch signal LAT and the change signals CHa and CHb. Here, in a case where delay occurring in the restoration circuit 130 is not added, the base latch signal oLAT and the base change signals oCHa and oCHb input to the restoration circuit 130 may have the same waveforms as the waveforms of the latch signal LAT and the change signals CHa and CHb output from the restoration circuit 130.

As described above, if the single-ended signal for controlling the liquid discharge apparatus 1 is input to the restoration circuit 130 in addition to the differential signal being a signal as a restoration target, it is possible to reduce a concern that a signal delay occurs between a single-ended signal restored by the restoration circuit 130 and a single-ended signal which is not restored by the restoration circuit 130.

The voltages VHV and VDD, the clock signal SCK, the latch signal LAT, the change signals CHa and CHb, and the ground signal GND1 are commonly input to each of the driving signal selection circuits 200-1 to 200-*n*. The driving signals COMA1 to COMAn and COMB1 to COMBn and the print data signals SI1 to SIn are input to the driving signal selection circuits 200-1 to 200-*n*, respectively. The driving signal selection circuits 200-1 to 200-*n* select or do not select the corresponding driving signals COMA1 to COMAn and COMB1 to COMBn so as to generate driving signals VOUT1 to VOUTn and supply the driving signals VOUT1 to VOUTn to one ends of the piezoelectric elements 60 in the plurality of corresponding discharge sections 600. Voltages VBS1 to VBSn are supplied to the other end of the piezoelectric element 60. The piezoelectric element 60 drives based on the driving signals VOUT1 to VOUTn and the voltages VBS1 to VBSn, and thus an ink having an amount depending on the driving of the piezoelectric element 60 is discharged from the discharge section 600.

Here, all of the driving signal selection circuits 200-1 to 200-*n* have the similar configuration, and thus may be referred to as a driving signal selection circuit 200 in the following descriptions. Descriptions may be made on the assumption that the driving signal selection circuit 200 generates the driving signal VOUT by selecting or not selecting the driving signals COMA and COMB based on the clock signal SCK, the print data signal SI, the latch signal LAT, and the change signals CHa and CHb.

Each of the restoration circuit 130 and the driving signal selection circuit 200 in the liquid discharge head 21 may be configured by one or a plurality of integrated circuits (ICs). The restoration circuit 130 and the driving signal selection circuit 200 may be configured in one integrated circuit.

3. Example of Waveform of Driving Signal

Here, an example of the waveforms of the driving signals COMA and COMB generated by the driving signal output circuit 50 and an example of the waveform of the driving signal VOUT supplied to the piezoelectric element 60 will be described with reference to FIGS. 3 and 4.

Figure 3:
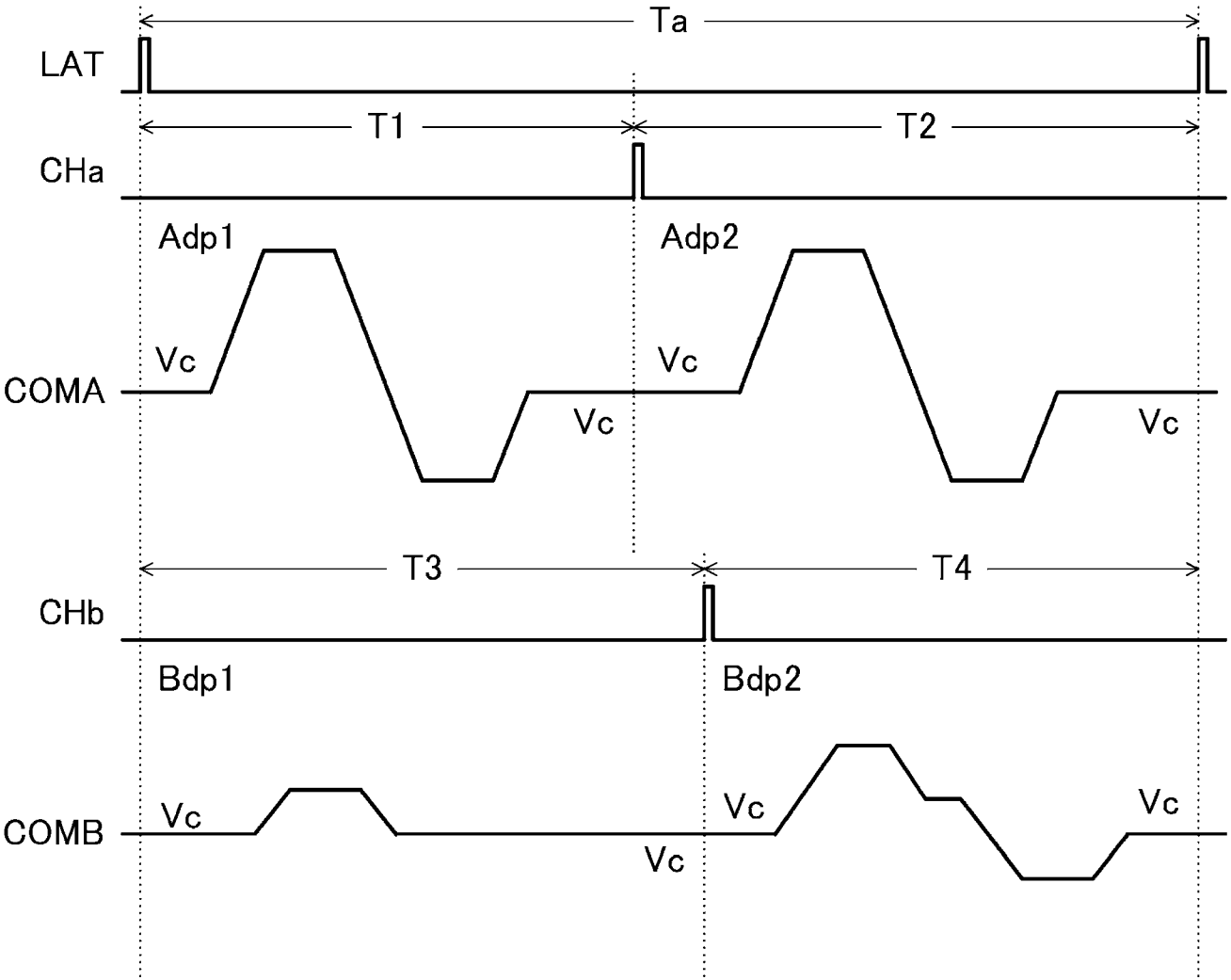
FIG. 3 is a diagram illustrating an example of driving signals COMA and COMB.

FIG. 3 is a diagram illustrating an example of the waveforms of the driving signals COMA and COMB. As illustrated in FIG. 3, the driving signal COMA has a waveform in which a trapezoid waveform Adp1 and a trapezoid waveform Adp2 are made continuous. The trapezoid waveform Adp1 is disposed in a period T1 from when the latch signal LAT rises until the change signal CHa rises. The trapezoid waveform Adp2 is disposed in a period T2 from when the change signal CHa rises until the latch signal LAT rises the next time. In the embodiment, the trapezoid waveform Adp1 and the trapezoid waveform Adp2 are substantially the same as each other. When each of the trapezoid waveforms Adp1 and Adp2 is supplied to one end of the piezoelectric element 60, the medium amount of the ink is discharged from the discharge section 600 corresponding to this piezoelectric element 60.

The driving signal COMB has a waveform in which a trapezoid waveform Bdp1 and a trapezoid waveform Bdp2 are made continuous. The trapezoid waveform Bdp1 is disposed in a period T3 from when the latch signal LAT rises until the change signal CHb rises. The trapezoid waveform Bdp2 is disposed in a period T4 from when the change signal CHb rises until the latch signal LAT rises the next time. In the embodiment, the trapezoid waveform Bdp1 and the trapezoid waveform Bdp2 are different from each other. Among the waveforms, the trapezoid waveform Bdp1 is a waveform for finely vibrating the ink in the vicinity of a nozzle opening portion of the discharge section 600 to prevent an increase of ink viscosity. When the trapezoid waveform Bdp1 is supplied to one end of the piezoelectric element 60, the ink is not discharged from the discharge section 600 corresponding to this piezoelectric element 60. The trapezoid waveform Bdp2 is different from the trapezoid waveforms Adp1 and Adp2 and the trapezoid waveform Bdp1. When the trapezoid waveform Bdp2 is supplied to one end of the piezoelectric element 60, an ink having an amount which is smaller than the medium amount is discharged from the discharge section 600 corresponding to this piezoelectric element 60.

Here, all voltages at a start timing and an end timing of each of the trapezoid waveforms Adp1, Adp2, Bdp1, and Bdp2 are common and a voltage Vc. That is, each of the trapezoid waveforms Adp1, Adp2, Bdp1, and Bdp2 is a waveform which starts at the voltage Vc and ends at the voltage Vc. Each of the driving signals COMA and COMB is described to be a signal having a waveform in which two trapezoid waveforms are continuous in the period Ta, but may be a signal having a waveform in which three trapezoid waveforms or more are continuous in the period Ta.

Figure 4:
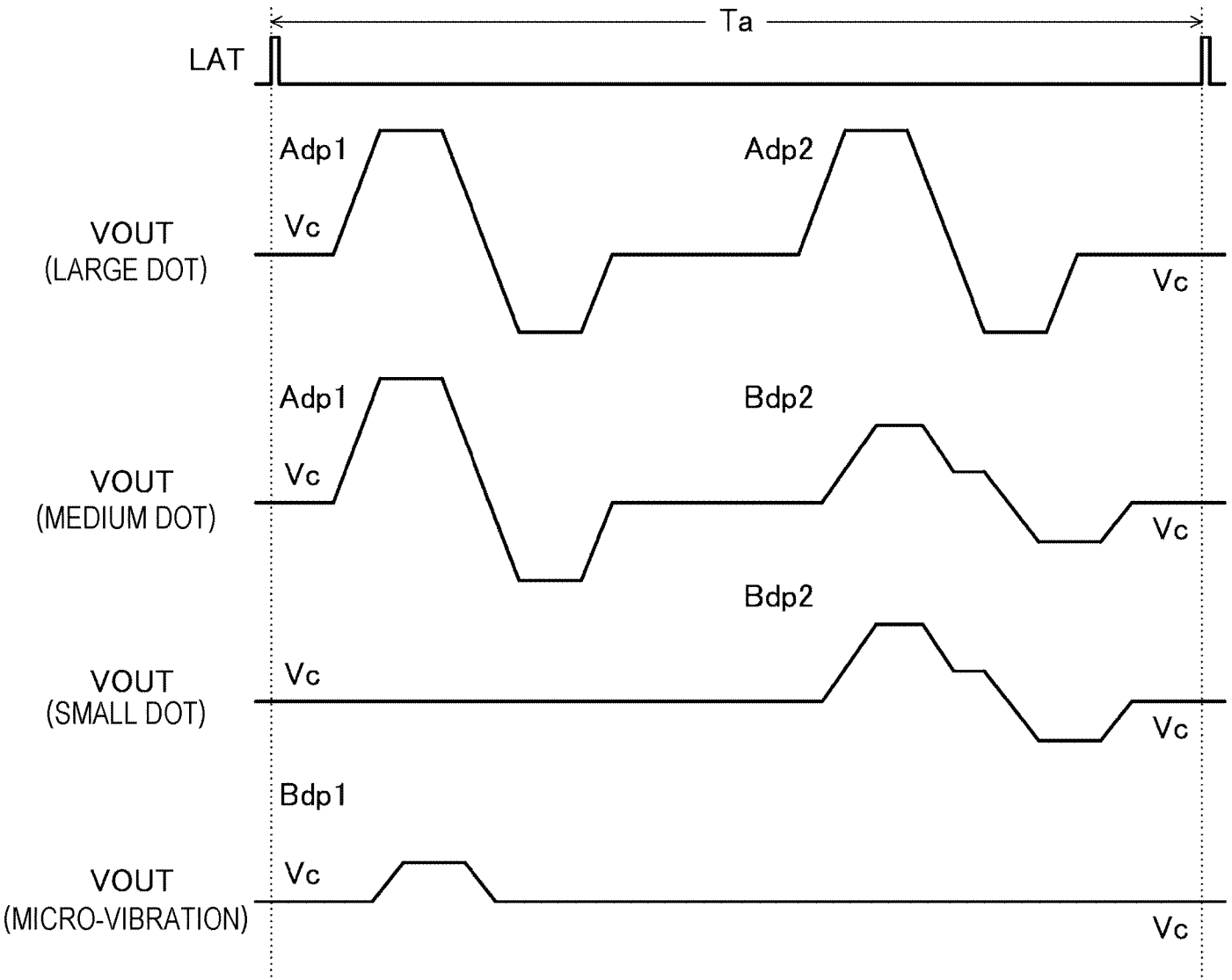
FIG. 4 is a diagram illustrating an example of a driving signal VOUT.

FIG. 4 is a diagram illustrating an example of the waveform of the driving signal VOUT corresponding to each of "a large dot", "a medium dot", "a small dot", and "non-recording". As illustrated in FIG. 4, the driving signal VOUT corresponding to "the large dot" has a waveform in which the trapezoid waveform Adp1 and the trapezoid waveform Adp2 are continuous in the period Ta. When the driving signal VOUT is supplied to the one end of the piezoelectric element 60, the medium amount of the ink is discharged two times from the discharge section 600 corresponding to this piezoelectric element 60, in the period Ta. Thus, the inks are landed on the medium P and are coalesced, and thereby a large dot is formed on the medium P.

The driving signal VOUT corresponding to "the medium dot" has a waveform in which the trapezoid waveform Adp1 and the trapezoid waveform Bdp2 are continuous in the period Ta. When the driving signal VOUT is supplied to the one end of the piezoelectric element 60, the medium amount of the ink and the small amount of the ink are discharged from the discharge section 600 corresponding to this piezoelectric element 60, in the period Ta. Thus, the inks are landed on the medium P and are coalesced, and thereby a medium dot is formed on the medium P.

The driving signal VOUT corresponding to "the small dot" has the trapezoid waveform Bdp2 in the period Ta. When the driving signal VOUT is supplied to the one end of the piezoelectric element 60, the small amount of the ink is discharged from the discharge section 600 corresponding to this piezoelectric element 60, in the period Ta. Thus, the inks are landed on the medium P, and thereby a small dot is formed on the medium P.

The driving signal VOUT corresponding to "non-recording" has the trapezoid waveform Bdp1 in the period Ta. When the driving signal VOUT is supplied to the one end of the piezoelectric element 60, in the period Ta, only the ink in the vicinity of the nozzle opening portion of the discharge section 600 corresponding to this piezoelectric element 60 finely vibrates, and the ink is not discharged. Therefore, the ink is not landed on the medium P, and a dot is not formed on the medium P.

Here, when any of the driving signals COMA and COMB is not selected as the driving signal VOUT, the voltage Vc just before is held at the one end of the piezoelectric element 60 by a capacitive component of the piezoelectric element 60. That is, when neither driving signals COMA nor COMB is selected, the voltage Vc is supplied to the piezoelectric element 60 as the driving signal VOUT.

The driving signals COMA and COMB and the driving signal VOUT illustrated in FIGS. 3 and 4 are just examples. Signals having various combinations of waveforms may be used in accordance with a moving speed of the carriage 20 in which the liquid discharge head 21 is mounted, the physical properties of the ink to be discharged, the material of the medium P, and the like. The driving signal COMA and the driving signal COMB may be signals having a waveform in which the same trapezoid waveforms are continuous. Here, the driving signals COMA and COMB are an example of the driving signal. Here, the driving signal VOUT generated by selecting or not selecting the waveforms of the driving signals COMA and COMB is also the driving signal in a broad sense.

4. Driving Signal Selection Circuit

Figure 5:
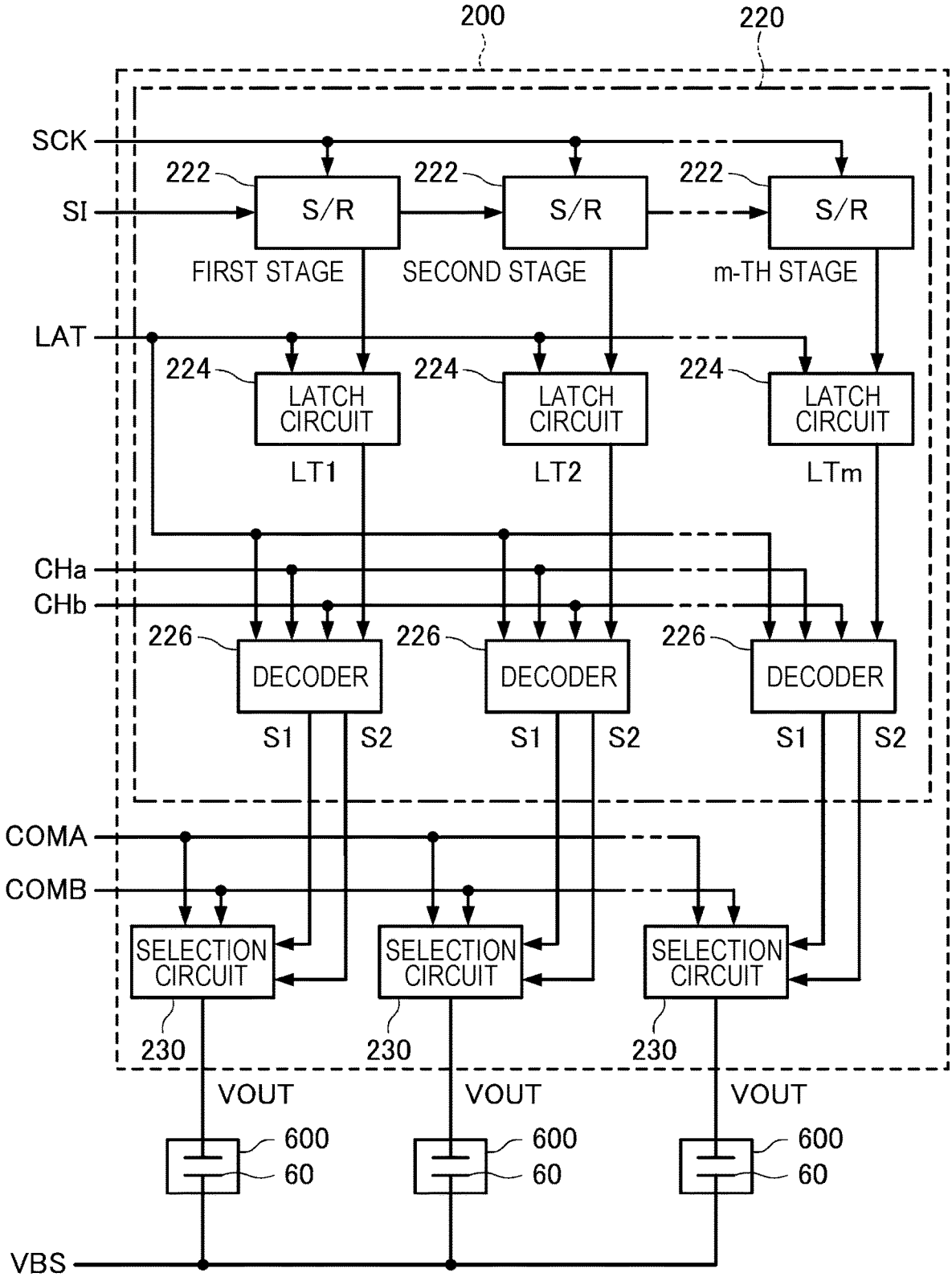
FIG. 5 is a diagram illustrating a configuration of a driving signal selection circuit.

Next, a configuration and an operation of the driving signal selection circuit 200 will be described with reference to FIGS. 5 to 8. FIG. 5 is a diagram illustrating a configuration of the driving signal selection circuit 200. As illustrated in FIG. 5, the driving signal selection circuit 200 includes a selection control circuit 220 and a plurality of selection circuits 230.

The print data signal SI, the latch signal LAT, the change signals CHa and CHb, and the clock signal SCK are input to the selection control circuit 220. A set of a shift register (S/R) 222, a latch circuit 224, and a decoder 226 is provided in the selection control circuit 220 to correspond to each of the plurality of discharge sections 600. That is, the driving signal selection circuit 200 includes sets of shift registers 222, latch circuits 224, and decoders 226. The number of sets is equal to the total number m of the corresponding discharge sections 600.

The print data signal SI is a signal for defining a waveform selection between the driving signal COMA and the driving signal COMB. Specifically, the print data signal SI is a signal synchronized with the clock signal SCK. The print data signal SI is a signal which has 2m bits in total and includes 2-bit print data [SIH, SIL] for selecting any of "the large dot", "the medium dot", "the small dot", and "non-recording" for each of m pieces of discharge sections 600. Regarding the print data signal SI, each 2-bit print data [SIH, SIL] which corresponds to the discharge section 600 and is included in the print data signal SI is held in the shift register 222. In detail, the shift registers 222 from the first stage to the m-th stage, which correspond to the discharge sections 600 are cascade-coupled to each other, and the print data signal SI supplied in a serial manner is sequentially transferred to the subsequent stages in accordance with the clock signal SCK. In FIG. 5, in order to distinguish the shift registers 222 from each other, the shift registers 222 are described as being the first stage, the second stage, . . . , and the m-th stage in order from the upstream on which the print data signal SI is supplied.

Each of the m pieces of latch circuits 224 latches the 2-bit print data [SIH, SIL] held in each of the m pieces of shift registers 222, at a rising edge of the latch signal LAT.

Each of the m pieces of decoders 226 decodes the 2-bit print data [SIH, SIL] latched by each of the m pieces of latch circuits 224. The decoder 226 outputs a selection signal S1 for each of the periods T1 and T2 defined by the latch signal LAT and the change signal CHa, and outputs a selection signal S2 for each of the periods T3 and T4 defined by the latch signal LAT and the change signal CHb.

Figures 6, 7:
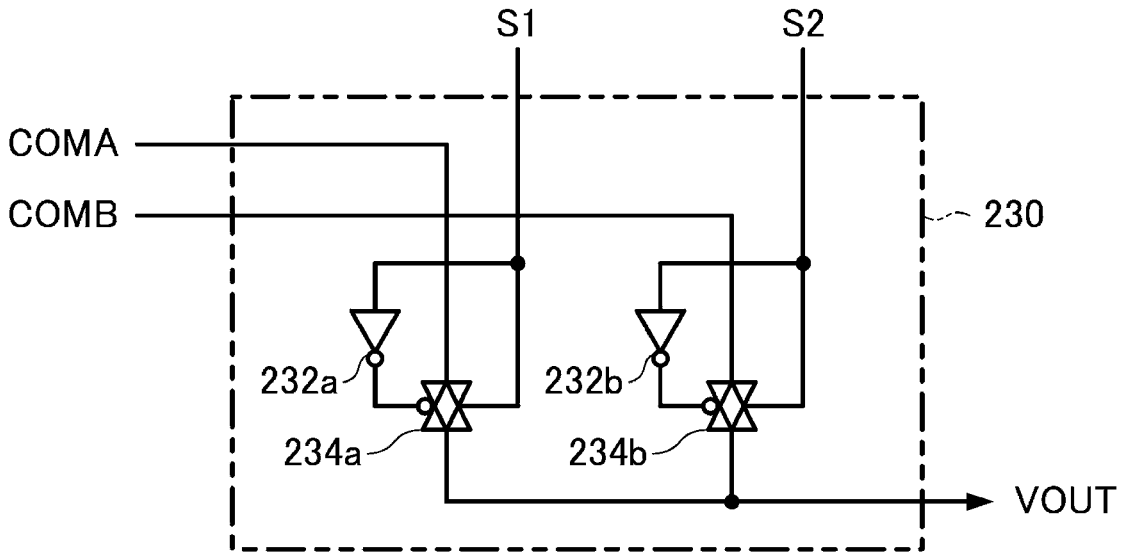
FIG. 6 is a diagram illustrating decoding contents in a decoder.
FIG. 7 is a diagram illustrating a configuration of a selection circuit corresponding to one discharge section.

FIG. 6 is a diagram illustrating decoding contents in the decoder 226. The decoder 226 outputs the selection signals S1 and S2 in accordance with the 2-bit print data [SIH, SIL] latched by the latch circuit 224. For example, when the 2-bit print data [SIH, SIL] latched by the latch circuit 224 is [1, 0], the decoder 226 sets a logical level of the selection signal S1 to respectively be an H level and an L level in the periods T1 and T2 and sets a logical level of the selection signal S2 to respectively be an L level and an H level in the periods T3 and T4. The logical levels of the selection signals S1 and S2 are subject to level shift to a high amplitude logic level based on the voltage VHV by a level shifter (not illustrated).

The selection circuits 230 are provided to correspond to the discharge sections 600, respectively. That is, the number of selection circuits 230 of the driving signal selection circuit 200 is equal to the total number m of the corresponding discharge sections 600.

FIG. 7 is a diagram illustrating a configuration of the selection circuit 230 corresponding to one discharge section 600. As illustrated in FIG. 7, the selection circuit 230 includes inverters 232*a* and 232*b* being NOT circuits, and transfer gates 234*a* and 234*b*.

The selection signal S1 is supplied to a positive control end of the transfer gate 234*a*, which is not marked with a circle, but is logically inverted by the inverter 232*a* and is supplied to a negative control end of the transfer gate 234*a*, which is marked with a circle. The selection signal S2 is supplied to a positive control end of the transfer gate 234*b*, but is logically inverted by the inverter 232*b* and is supplied to a negative control end of the transfer gate 234*b*.

The driving signal COMA is supplied to an input end of the transfer gate 234*a*. The driving signal COMB is supplied to an input end of the transfer gate 234*b*. Output ends of the transfer gates 234*a* and 234*b* are commonly coupled to each other, and the driving signal VOUT is output to the discharge section 600 through the commonly-coupled terminals.

The transfer gate 234*a* electrically connects the input end and an output end when the selection signal S1 has an H level, and does not electrically connect the input end and the output end when the selection signal S1 has an L level. The transfer gate 234*b* electrically connects the input end and an output end when the selection signal S2 has an H level, and does not electrically connect the input end and the output end when the selection signal S2 has an L level.

Figure 8:
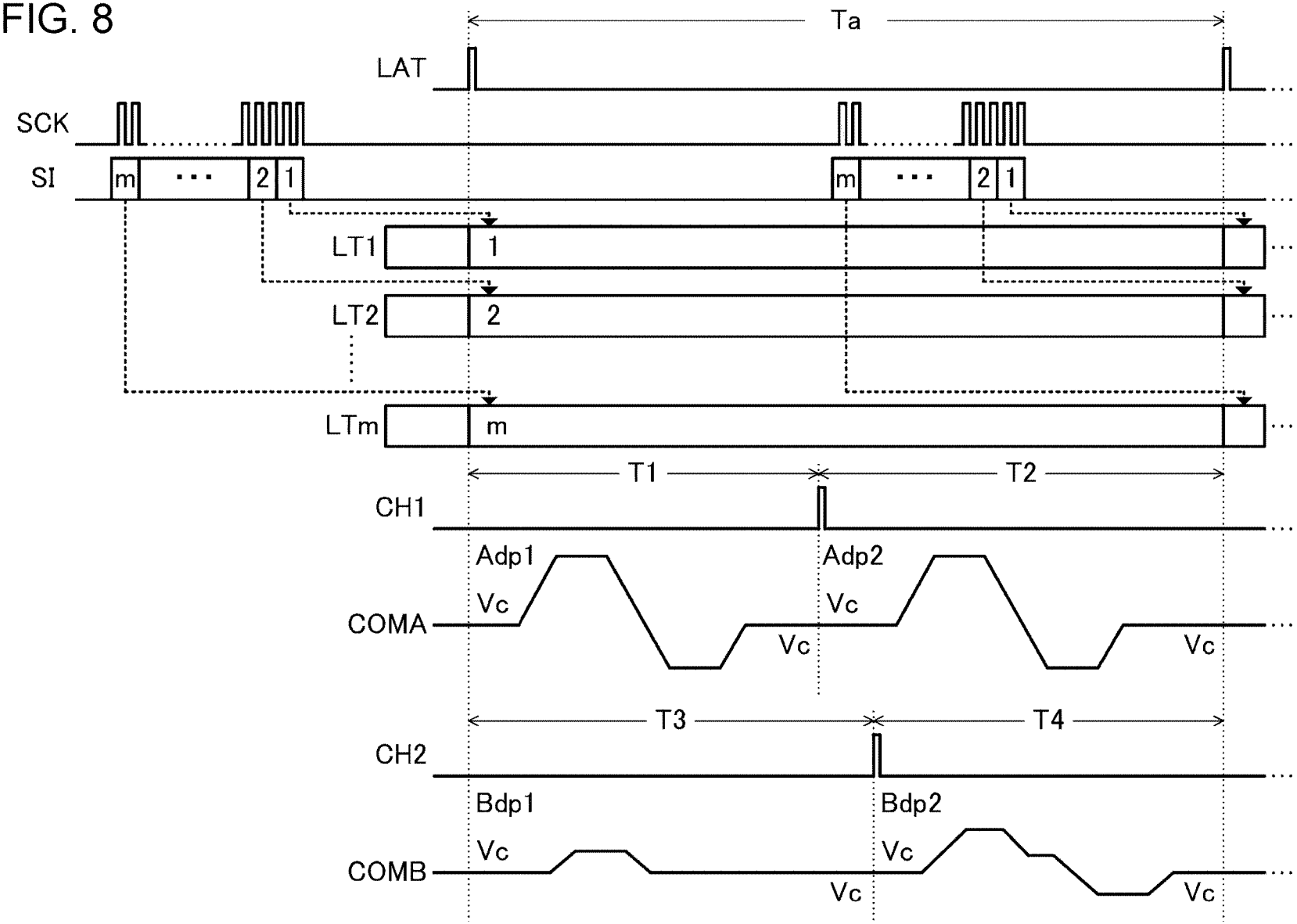
FIG. 8 is a diagram illustrating an operation of the driving signal selection circuit.

Next, an operation of the driving signal selection circuit 200 will be described with reference to FIG. 8. FIG. 8 is a diagram illustrating the operation of the driving signal selection circuit 200. The print data signal SI is serially supplied in synchronization with the clock signal SCK and is sequentially transferred into the shift registers 222 corresponding to the discharge sections 600. If the supply of the clock signal SCK stops, the 2-bit print data [SIH, SIL] corresponding to each of the discharge sections 600 is held in each of the shift registers 222. The print data signal SI is supplied in order of the discharge sections 600 corresponding to the m-th stage, . . . , the second stage, and the first stage of the shift registers 222.

If the latch signal LAT rises, the latch circuits 224 simultaneously latch the 2-bit print data [SIH, SIL] held by the shift registers 222. In FIG. 8, LT1, LT2, . . . , and LTm indicate the 2-bit print data [SIH, SIL] latched by the latch circuits 224 respectively corresponding to the first stage, the second stage, . . . , and the m-th stage of the shift registers 222.

The decoder 226 outputs the logical levels of the selection signals S1 and S2 in each of the periods T1, T2, T3, and T4 with the contents as illustrated in FIG. 6, in accordance with the size of a dot defined by the latched 2-bit print data [SIH, SIL].

Specifically, when the print data[SIH, SIL] is [1, 1], the decoder 226 sets the selection signal S1 to have an H level and an H level in the periods T1 and T2, and sets the selection signal S2 to have an L level and an L level in the periods T3 and T4. In this case, the selection circuit 230 selects the trapezoid waveform Adp1 included in the driving signal COMA in the period T1, selects the trapezoid waveform Adp2 included in the driving signal COMA in the period T2, does not select the trapezoid waveform Bdp1 included in the driving signal COMB in the period T3, and does not select the trapezoid waveform Bdp2 included in the driving signal COMB in the period T4. As a result, the driving signal VOUT corresponding to "the large dot" illustrated in FIG. 4 is generated.

When the print data [SIH, SIL] is [1, 0], the decoder 226 sets the selection signal S1 to have an H level and an L level in the periods T1 and T2, and sets the selection signal S2 to have an L level and an H level in the periods T3 and T4. In this case, the selection circuit 230 selects the trapezoid waveform Adp1 included in the driving signal COMA in the period T1, does not select the trapezoid waveform Adp2 included in the driving signal COMA in the period T2, does not select the trapezoid waveform Bdp1 included in the driving signal COMB in the period T3, and selects the trapezoid waveform Bdp2 included in the driving signal COMB in the period T4. As a result, the driving signal VOUT corresponding to "the medium dot" illustrated in FIG. 4 is generated.

When the print data [SIH, SIL] is [0, 1], the decoder 226 sets the selection signal S1 to have an L level and an L level in the periods T1 and T2, and sets the selection signal S2 to have an L level and an H level in the periods T3 and T4. In this case, the selection circuit 230 does not select the trapezoid waveform Adp1 included in the driving signal COMA in the period T1, does not select the trapezoid waveform Adp2 included in the driving signal COMA in the period T2, does not select the trapezoid waveform Bdp1 included in the driving signal COMB in the period T3, and selects the trapezoid waveform Bdp2 included in the driving signal COMB in the period T4. As a result, the driving signal VOUT corresponding to "the small dot" illustrated in FIG. 4 is generated.

When the print data [SIH, SIL] is [0, 0], the decoder 226 sets the selection signal S1 to have an L level and an L level in the periods T1 and T2, and sets the selection signal S2 to have an H level and an L level in the periods T3 and T4. In this case, the selection circuit 230 does not select the trapezoid waveform Adp1 included in the driving signal COMA in the period T1, does not select the trapezoid waveform Adp2 included in the driving signal COMA in the period T2, selects the trapezoid waveform Bdp1 included in the driving signal COMB in the period T3, and does not select the trapezoid waveform Bdp2 included in the driving signal COMB in the period T4. As a result, the driving signal VOUT corresponding to "non-recording" illustrated in FIG. 4 is generated.

As described above, each of the driving signal selection circuits 200-1 to 200-*n* controls the selection circuit 230 based on the corresponding print data signals SI1 to SIn, the latch signal LAT, and the change signals CHa and CHb. The driving signal selection circuits 200-1 to 200-*n* control supplies of the corresponding driving signals COMA1 to COMAn and COMB1 to COMBn to the piezoelectric element by an operation of the selection circuit 230, respectively. Here, the selection circuit 230 is an example of a switch circuit.

5. Coupling Between Liquid Discharge Head and Liquid Discharge Head Control Circuit and Configuration of Each Component Next, details of an electrical coupling between the control mechanism 10 and the liquid discharge head 21 will be described. The following descriptions will be made on the assumption that the liquid discharge head 21 includes twelve driving signal selection circuits 200-1 to 200-12. That is, twelve print data signals SI1 to SI12, twelve driving signals COMA1 to COMA12 and COMB1 to COMB12, and twelve voltages VBS1 to VBS12, which respectively correspond to the twelve driving signal selection circuits 200-1 to 200-12, are input to the liquid discharge head 21. The control mechanism 10 includes twelve driving signal output circuits 50-1 to 50-12 and twelve reference voltage signal output circuits 53-1 to 53-*n*, which correspond to the twelve driving signal selection circuits 200-1 to 200-12, respectively.

Figure 9:
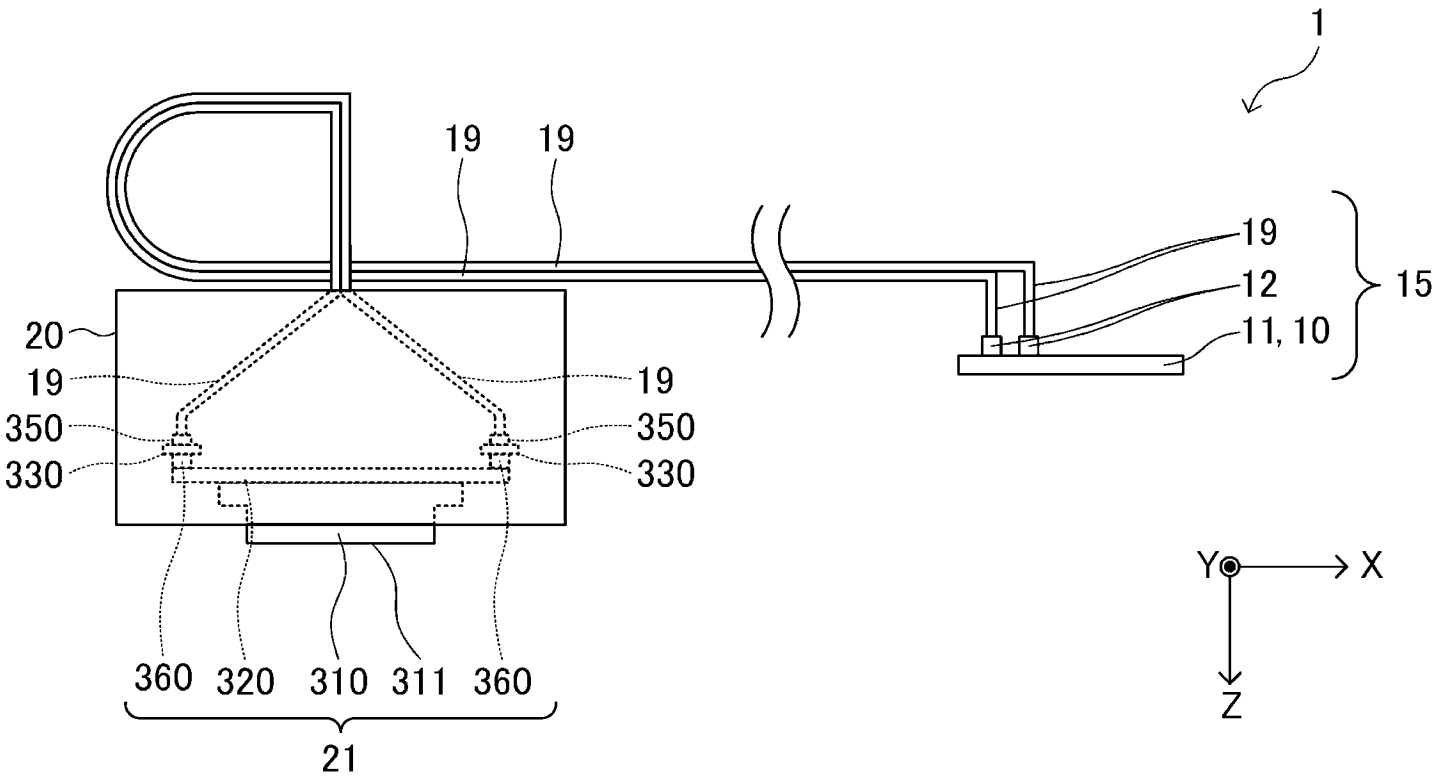
FIG. 9 is a schematic diagram illustrating an internal configuration of the liquid discharge apparatus.

FIG. 9 is a schematic diagram illustrating an internal configuration of the liquid discharge apparatus 1 when viewed from the Y-direction. As illustrated in FIG. 9, the liquid discharge apparatus 1 includes a main substrate 11, the liquid discharge head 21, a relay substrate 330, and a plurality of cables 19.

Various circuits including the conversion circuit 70, the driving signal output circuits 50-1 to 50-12, the reference voltage signal output circuits 53-1 to 53-*n*, the first power source voltage output circuit 51, the second power source voltage output circuit 52, and the control circuit 100 provided in the control mechanism 10 illustrated in FIGS. 1 and 2 are mounted on the main substrate 11. A plurality of connectors 12 to which one ends of the plurality of cables 19 are respectively attached are mounted on the main substrate 11. FIG. 9 illustrates one circuit substrate as the main substrate 11. However, the main substrate 11 may be configured by two circuit substrates or more.

One or a plurality of connectors 350 are provided on the relay substrate 330. The other end of the cable 19 is coupled to one or each of the plurality of connectors 350 provided on the relay substrate 330.

The liquid discharge head 21 includes a head 310 and a head substrate 320. The liquid discharge head 21 and the relay substrate 330 are coupled to each other by a connector 360 being a board-to-board (BtoB) connector that couples substrates to each other. Thus, various signals generated by the control mechanism 10 provided on the main substrate 11 are input to the liquid discharge head 21 through the plurality of cables 19 and the relay substrate 330. Details of the configuration of the liquid discharge head 21 and details of signals propagated in the plurality of cables 19 will be described later.

The liquid discharge apparatus 1 configured in a manner as described above controls the operation of the liquid discharge head 21 based on various signals including the driving signals COMA1 to COMA12 and COMB1 to COMB12, the voltages VBS1 to VBS12, the differential clock signal dSCK, the differential print data signals dSI1 to dSI12, the base latch signal oLAT, and the base change signals oCHa and oCHb, which are output from the control mechanism 10 mounted on the main substrate 11. That is, in the liquid discharge apparatus 1 illustrated in FIG. 9, a configuration including the control mechanism 10 that outputs various signals for controlling the operation of the liquid discharge head 21, the plurality of cables 19 for propagating the various signals for controlling the operation of the liquid discharge head 21, and the relay substrate 330 is referred to as the liquid discharge head control circuit 15 that controls the operation of the liquid discharge head 21 that discharges the ink from nozzles 651.

Figure 10:
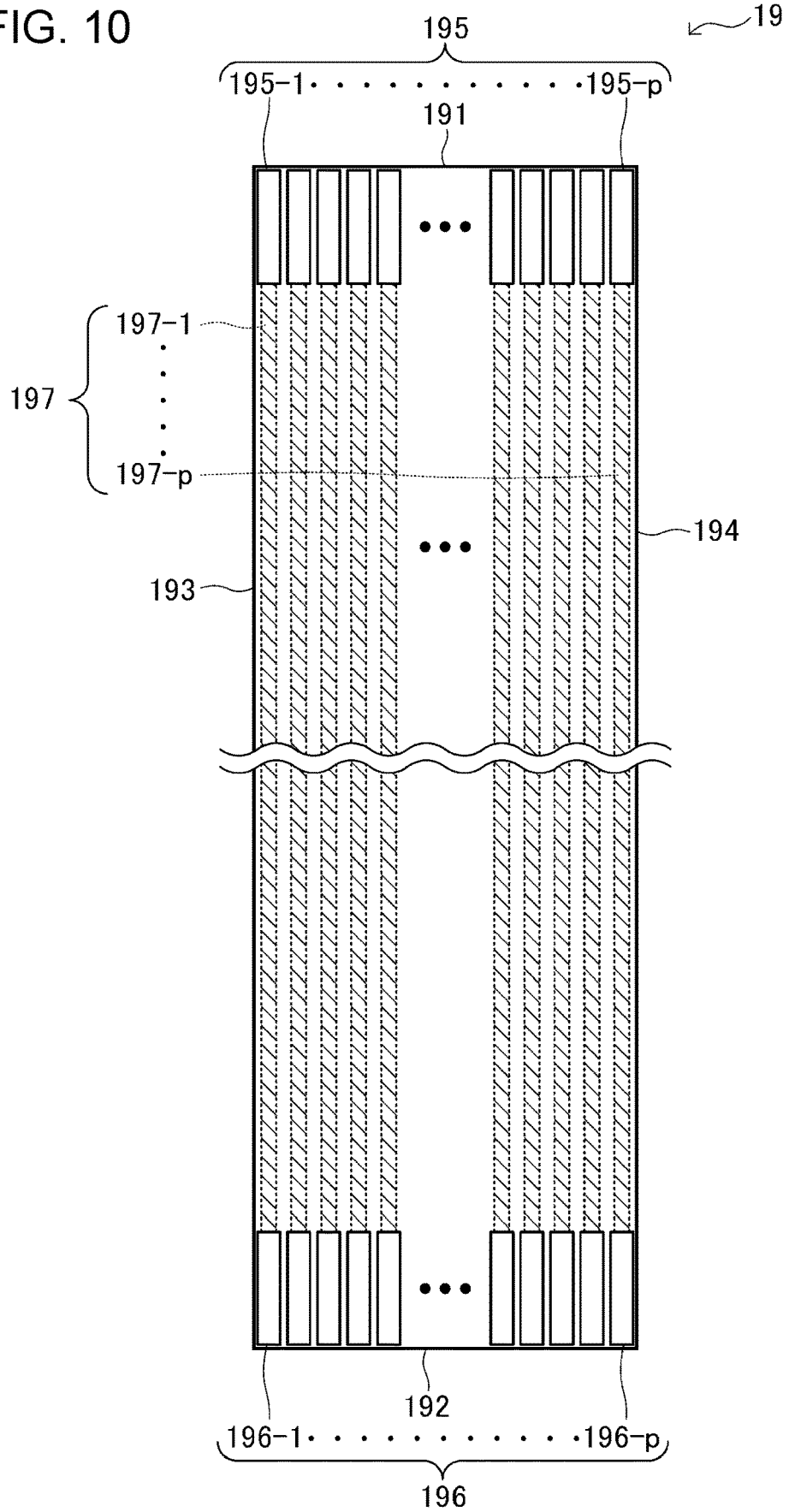
FIG. 10 is a diagram illustrating a configuration of a cable.

FIG. 10 is a diagram illustrating a configuration of the cable 19. The cable 19 has a substantially rectangular shape having short sides 191 and 192 facing each other and long sides 193 and 194 facing each other. For example, the cable 19 is a flexible flat cable (FFC). The cable 19 includes a plurality of terminals 195 arranged in parallel along the short side 191, a plurality of terminals 196 arranged in parallel along the short side 192, and a plurality of wirings 197 that electrically couple the plurality of terminals 195 and the plurality of terminals 196 to each other.

Specifically, p pieces of terminals 195 are arranged in parallel from the long side 193 toward the long side 194, on the short side 191 side of the cable 19 in order of the terminals 195-1 to 195-*p*. p pieces of terminals 196 are arranged in parallel from the long side 193 toward the long side 194, on the short side 192 side of the cable 19 in order of the terminals 196-1 to 196-*p*. In the cable 19, p pieces of wirings 197 that electrically and respectively couple the terminals 195 and the terminals 196 to each other are arranged in parallel from the long side 193 toward the long side 194 in order of the wirings 197-1 to **197-*p*. The wiring 197-1 electrically couples the terminal 195-1 and the terminal 196-1 to each other. Similarly, the wiring 197-*j* (j is any of 1 to p) electrically couples the terminal 195-*j* and the terminal 196-*j* to each other. The cable 19 configured as described above is used for propagating a signal input from the terminal 195-*j* in the wiring 197-*j* and outputting the signal from the terminal 196-*j*. The configuration of the cable 19 illustrated in FIG. 10 is an example and is not limited thereto. For example, the plurality of terminals 195 and the plurality of terminals 196 may be provided on different surfaces of the cable 19**.

Figure 11:
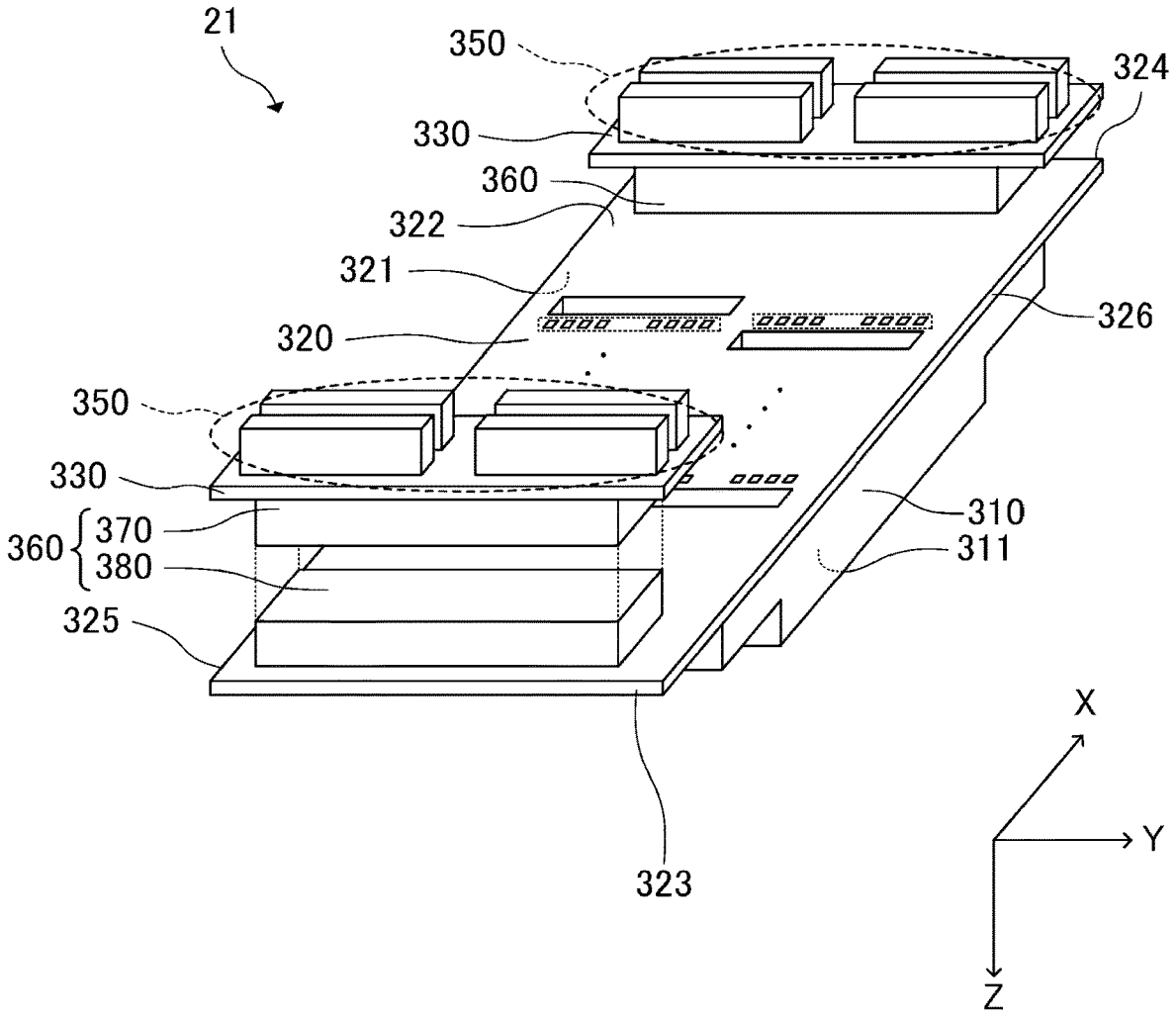
FIG. 11 is a perspective view illustrating configurations of a liquid discharge head and a relay substrate.

Next, configurations of the relay substrate 330 that relays the signal propagated in each of the plurality of cables 19 and the liquid discharge head 21 to which the signal is input will be described. FIG. 11 is a perspective view illustrating the configurations of the liquid discharge head 21 and the relay substrate 330.

As illustrated in FIG. 11, the liquid discharge head 21 includes the head 310 and the head substrate 320. The head substrate 320 has a surface 321 and a surface 322 different from the surface 321. The head substrate 320 is electrically coupled to the relay substrate 330 through the connector 360, on the surface 322 side. Specifically, the connector 360 includes a connector 370 provided on the relay substrate 330 and a connector 380 provided on the head substrate 320. The connector 370 and the connector 380 are fit with each other, and thereby the relay substrate 330 and the head substrate 320 are electrically coupled to each other. The head 310 is provided on the surface 321 side of the head substrate 320. An ink discharge surface 311 on which the plurality of discharge sections 600 are formed is located on a lower surface of the head 310 in the Z-direction.

Figure 12:
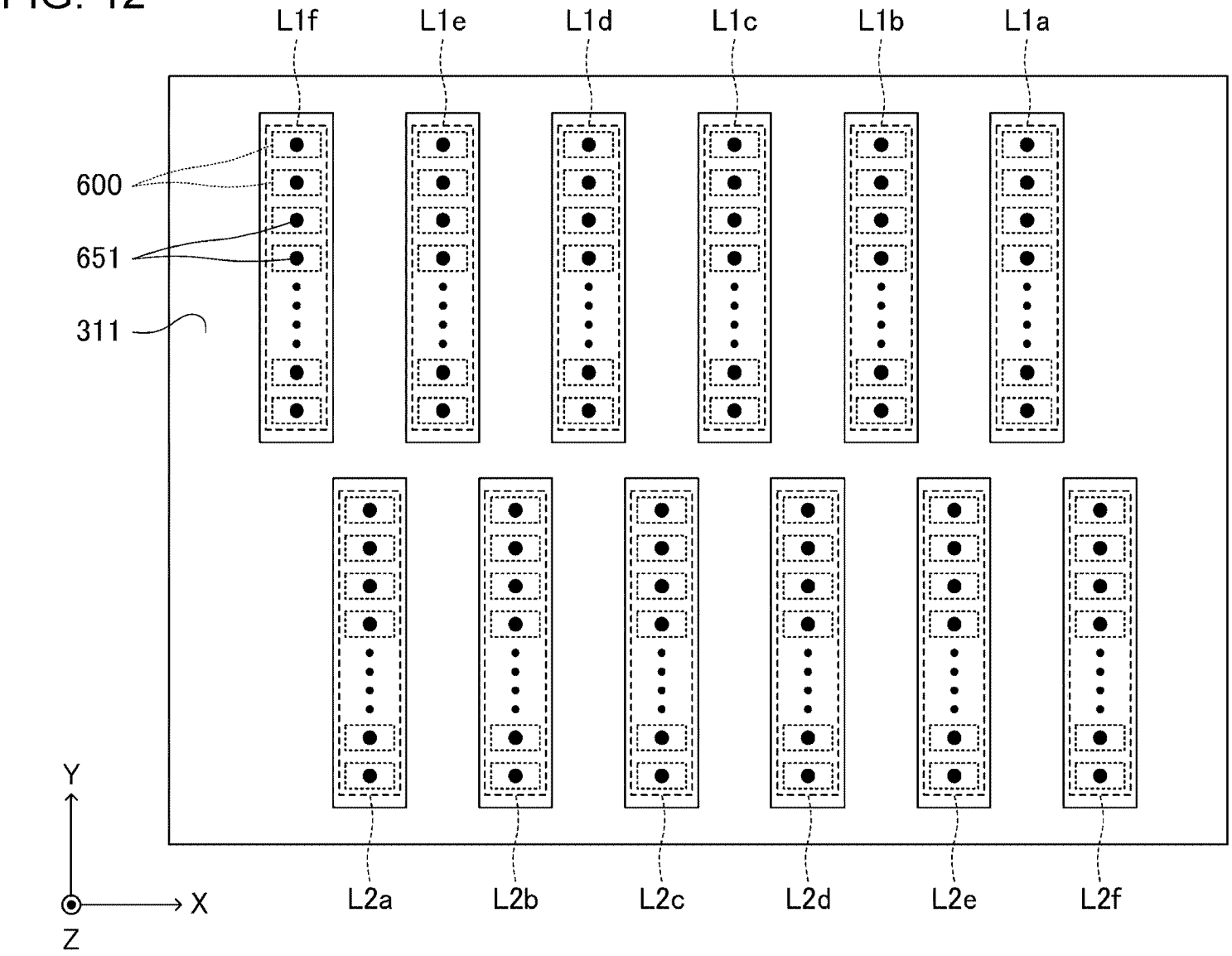
FIG. 12 is a plan view illustrating a configuration of an ink discharge surface.

FIG. 12 is a plan view illustrating a configuration of the ink discharge surface 311. As illustrated in FIG. 12, twelve nozzle plates 632 are provided on the ink discharge surface 311. The nozzle plate 632 has nozzles 651 provided in the plurality of discharge sections 600. Nozzle lines L1*a* to L1*f* and L2*a* to L2*f* are formed in each of the nozzle plates 632. In each of the nozzle lines, the nozzles 651 are arranged side by side in the Y-direction.

The nozzle lines L1*a* to L1*f* are provided to be arranged from the right to the left in FIG. 12 in the X-direction in order of the nozzle lines L1*a*, L1*b*, L1*c*, L1*d*, L1*e*, and L1*f*. The nozzle lines L2*a* to L2*f* are provided to be arranged from the left to the right in FIG. 12 in the X-direction in order of the nozzle lines L2*a*, L2*b*, L2*c*, L2*d*, L2*e*, and L2*f*. Further, the nozzle lines L1*a* to L1*f* and the nozzle lines L2*a* to L2*f* are provided such that two lines are arranged side by side in the Y-direction. That is, the nozzle lines L1*a* to L1*f* and the nozzle lines L2*a* to L2*f* in which the plurality of nozzles 651 are formed in the Y-direction are formed in the ink discharge surface 311 such that two lines are arranged in the X-direction. In FIG. 12, the nozzles 651 are provided to be arranged in one line in the Y-direction in each of the nozzle lines L1*a* to L1*f* and L2*a* to L2*f*. However, the nozzles 651 may be provided to be arranged in two lines or more in the Y-direction.

The nozzle lines L1*a* to L1*f* and L2*a* to L2*f* correspond to the driving signal selection circuits 200, respectively. Specifically, the driving signal selection circuit 200-1 corresponds to the nozzle line L1*a*. The driving signal VOUT1 output by the driving signal selection circuit 200-1 is supplied to the one end of the piezoelectric element 60 in a plurality of discharge sections 600 provided in the nozzle line L1*a*. The voltage VBS1 is supplied to the other end of this piezoelectric element 60. Similarly, nozzle lines L1*b* to L1*f* correspond to the driving signal selection circuit 200-2 to 200-6, respectively. The driving signals VOUT2 to VOUT6 and the voltages VBS2 to VBS6 are supplied to the driving signal selection circuit 200-2 to 200-6, respectively. The nozzle lines L2*a* to L2*f* correspond to the driving signal selection circuit 200-7 to 200-12, respectively. The driving signals VOUT7 to VOUT12 and the voltages VBS7 to VBS12 are supplied to the driving signal selection circuit 200-7 to 200-12, respectively.

Figure 13:
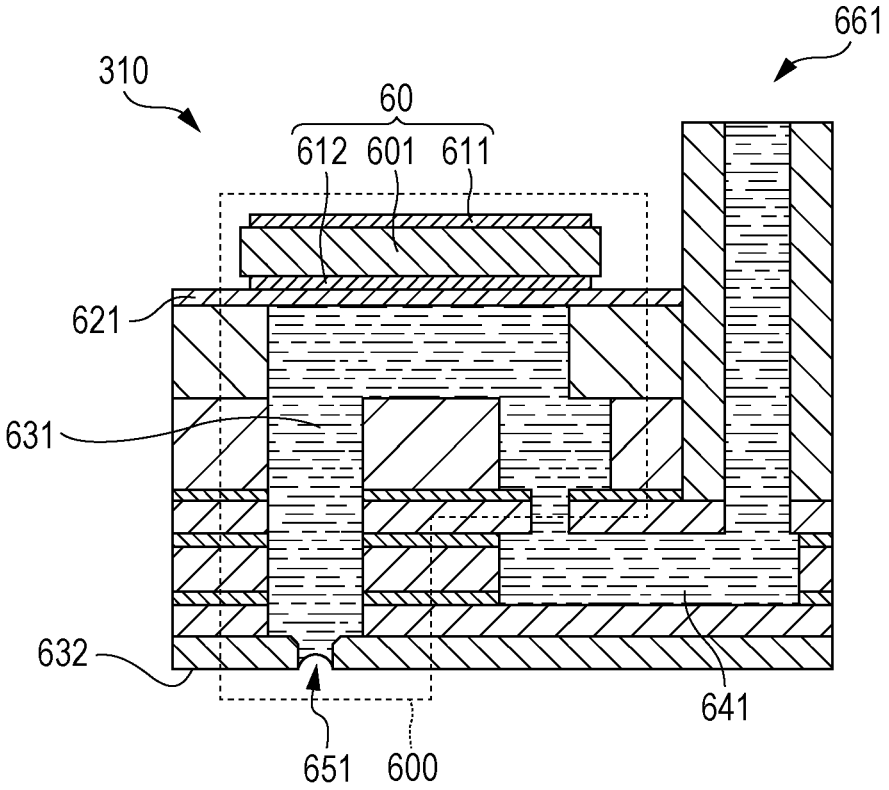
FIG. 13 is a diagram illustrating an overall configuration of one of a plurality of discharge sections.

Next, the configuration of the discharge section 600 in the head 310 will be described with reference to FIG. 13. FIG. 13 is a diagram illustrating an overall configuration of one of the plurality of discharge sections 600 in the head 310. As illustrated in FIG. 13, the head 310 includes the discharge section 600 and a reservoir 641.

The reservoir 641 is provided to correspond to each of the nozzle lines L1*a* to L1*f* and L2*a* to L2*f*. The ink is supplied from an ink supply port 661 into the reservoir 641.

The discharge section 600 includes the piezoelectric element 60, a vibration plate 621, a cavity 631, and the nozzle 651. The vibration plate 621 deforms by driving of the piezoelectric element 60 provided on an upper surface in FIG. 13. The vibration plate 621 functions as a diaphragm of increasing and reducing the internal volume of the cavity 631. The cavity 631 is filled with the ink. The cavity 631 functions as a pressure chamber having an internal volume which changes by the deformation of the vibration plate 621. The nozzle 651 is an opening portion which is formed in the nozzle plate 632 and communicates with the cavity 631. The ink stored in the cavity 631 is discharged from the nozzle 651 by the change of the internal volume of the cavity 631.

The piezoelectric element 60 has a structure in which a piezoelectric substance 601 is interposed between a pair of electrodes 611 and 612. In the piezoelectric element 60 having such a structure, the central portions of the electrodes 611 and 612 and the vibration plate 621 bend with respect to both end portions thereof in an up-and-down direction in FIG. 13, in accordance with a voltage supplied to the electrodes 611 and 612. Specifically, the driving signal VOUT is supplied to the electrode 611 as one end, and the voltage VBS is supplied to the electrode 612 as the other end. If the voltage of the driving signal VOUT is high, the central portion of the piezoelectric element 60 bends upward. If the voltage of the driving signal VOUT is low, the central portion of the piezoelectric element 60 bends downward. That is, if the piezoelectric element 60 bends upward, the internal volume of the cavity 631 increases. Thus, the ink is drawn from the reservoir 641. If the piezoelectric element 60 bends downward, the internal volume of the cavity 631 is reduced. Accordingly, the ink of the amount depending on the reduced degree of the internal volume of the cavity 631 is discharged from the nozzle 651. As described above, the driving signal VOUT based on the driving signals COMA and COMB is supplied, and thereby the piezoelectric element 60 drives. Thus, the piezoelectric element 60 drives by the driving signal VOUT based on the driving signals COMA1 to COMAn and COMB1 to COMBn, and thereby the liquid discharge head 21 discharges the ink from the nozzle 651. The piezoelectric element 60 is not limited to the structure illustrated in FIG. 13. Any type may be provided so long as the piezoelectric element is capable of discharging the ink with the displacement of the piezoelectric element 60. The piezoelectric element 60 is not limited to flexural vibration, and may be configured to use longitudinal vibration.

Figure 14:
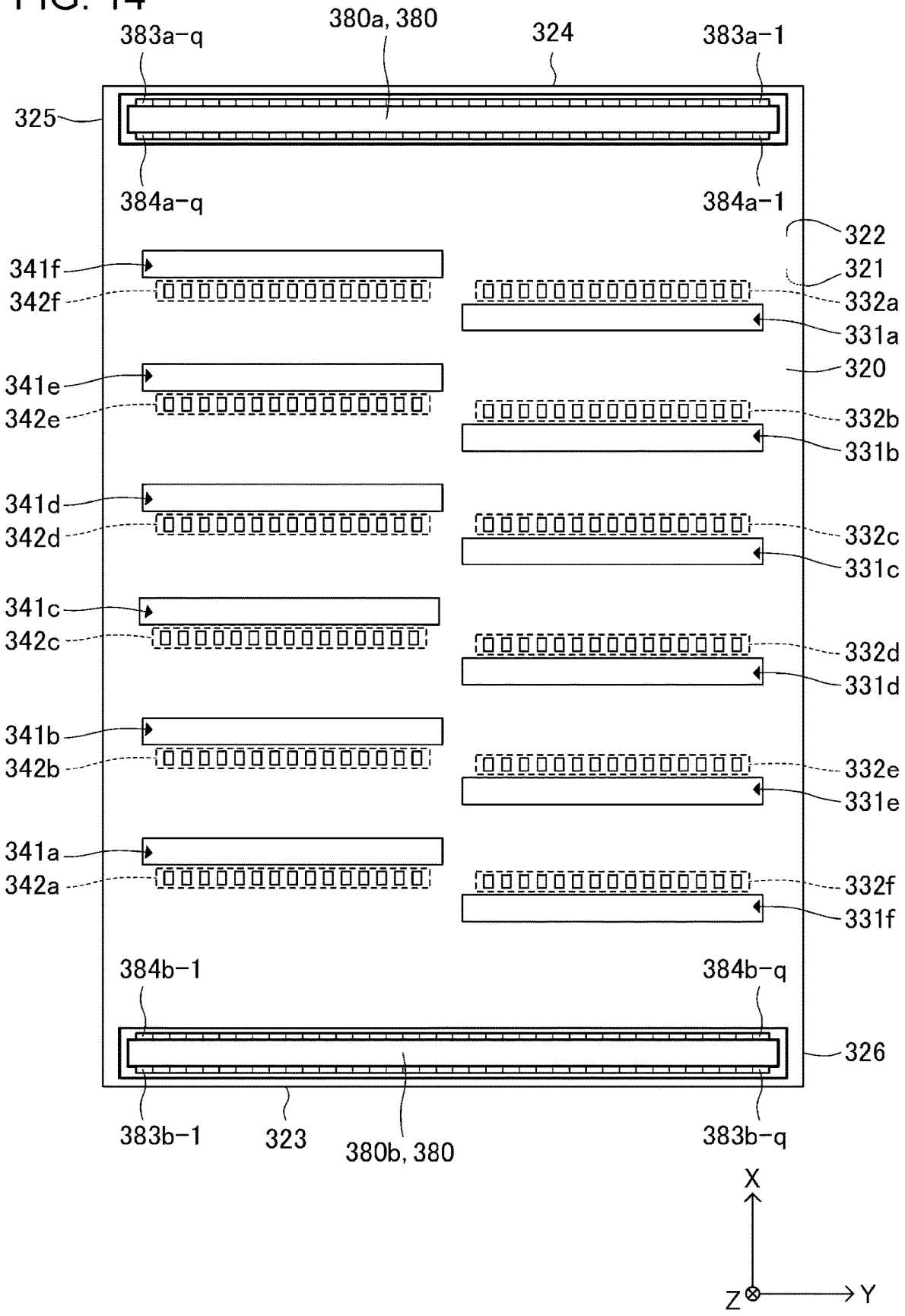
FIG. 14 is a plan view when a head substrate is viewed from a surface 322.

Next, a configuration of the head substrate 320 will be described with reference to FIG. 14. FIG. 14 is a plan view when the head substrate 320 is viewed from the surface 322. The head substrate 320 has a substantially rectangular shape formed by a side 323, a side 324 (facing the side 323 in the X-direction), a side 325, and a side 326 (facing the side 325 in the Y-direction). The shape of the head substrate 320 is not limited to a rectangle. For example, the shape of the head substrate 320 may be a polygon such as a hexagon or an octagon, or may have a shape in which a notch or an arc is formed.

FPC insertion holes 331*a* to 331*f* and 341*a* to 341*f*, electrode groups 332*a* to 332*f* and 342*a* to 342*f*, and the plurality of connectors 380 are provided in the head substrate 320.

Each of the electrode groups 332*a* to 332*f* and 342*a* to 342*f* includes a plurality of electrodes arranged in parallel in the Y-direction. The electrode groups 332*a* to 332*f* are provided to be arranged from the side 324 toward the side 323 along the side 326 in order of the electrode groups 332*a*, 332*b*, 332*c*, 332*d*, 332*e*, and 332*f*. The electrode groups 342*a* to 342*f* are provided to be arranged from the side 323 toward the side 324 along the side 325 in order of the electrode groups 342*a*, 342*b*, 342*c*, 342*d*, 342*e*, and 342*f*. A flexible printed circuit (FPC) (not illustrated) is electrically coupled to each of the electrode groups 332*a* to 332*f* and 342*a* to 342*f* provided in a manner as described above.

The FPC coupled to the electrode group 332*a* propagates various signals supplied to the electrode group 332*a* to the driving signal selection circuit 200-1. That is, various control signals for controlling an operation of the nozzle line L1*a* are supplied to the electrode group 332*a*. Similarly, the FPC coupled to the electrode groups 332*b* to 332*f* propagates various signals supplied to the electrode groups 332*b* to 332*f* to the driving signal selection circuits 200-2 to 200-6, respectively. That is, various control signals for controlling operations of the nozzle lines L1*b* to L1*f* are supplied to the electrode groups 332*b* to 332*f*, respectively. Similarly, the FPC coupled to the electrode groups 342*a* to 342*f* propagates various signals supplied to the electrode groups 342*a* to 342*f* to the driving signal selection circuits 200-7 to 200-12, respectively. That is, various control signals for controlling operations of the nozzle lines L2*a* to L2*f* are supplied to the electrode groups 342*a* to 342*f*, respectively.

The FPC insertion holes 331*a* to 331*f* and 341*a* to 341*f* are through-holes penetrating the surface 321 and the surface 322 of the head substrate 320. FPCs which are electrically coupled to the electrode groups 332*a* to 332*f* and 342*a* to 342*f* is inserted into the FPC insertion holes 331*a* to 331*f* and 341*a* to 341*f*, respectively.

Specifically, the FPC insertion hole 331*a* is provided between the electrode group 332*a* and the electrode group 332*b*. The FPC insertion hole 331*b* is provided between the electrode group 332*b* and the electrode group 332*c*. The FPC insertion hole 331*c* is provided between the electrode group 332*c* and the electrode group 332*d*. The FPC insertion hole 331*d* is provided between the electrode group 332*d* and the electrode group 332*e*. The FPC insertion hole 331*e* is provided between the electrode group 332*e* and the electrode group 332*f*. The FPC insertion hole 331*f* is provided on the side 323 side of the electrode group 332*f*. The FPCs which are electrically coupled to the electrode groups 332*a* to 332*f* are inserted into the FPC insertion holes 331*a* to 331*f*, respectively.

The FPC insertion hole 341*a* is provided between the electrode group 342*a* and the electrode group 342*b*. The FPC insertion hole 341*b* is provided between the electrode group 342*b* and the electrode group 342*c*. The FPC insertion hole 341*c* is provided between the electrode group 342*c* and the electrode group 342*d*. The FPC insertion hole 341*d* is provided between the electrode group 342*d* and the electrode group 342*e*. The FPC insertion hole 341*e* is provided between the electrode group 342*e* and the electrode group 342*f*. The FPC insertion hole 341*f* is provided on the side 324 side of the electrode group 342*f*. The FPCs which are electrically coupled to the electrode groups 342*a* to 342*f* are inserted into the FPC insertion holes 341*a* to 341*f*, respectively.

A connector 380*a* among the plurality of connectors 380 is provided on the side 324 side of the electrode group 332*a* to 332*f* and 342*a* to 342*f* and the FPC insertion holes 331*a* to 331*f* and 341*a* to 341*f*. The connector 380*b* among the plurality of connectors 380 is provided on the side 323 side of the electrode groups 332*a* to 332*f* and 342*a* to 342*f* and the FPC insertion holes 331*a* to 331*f* and 341*a* to 341*f*.

Figure 15:
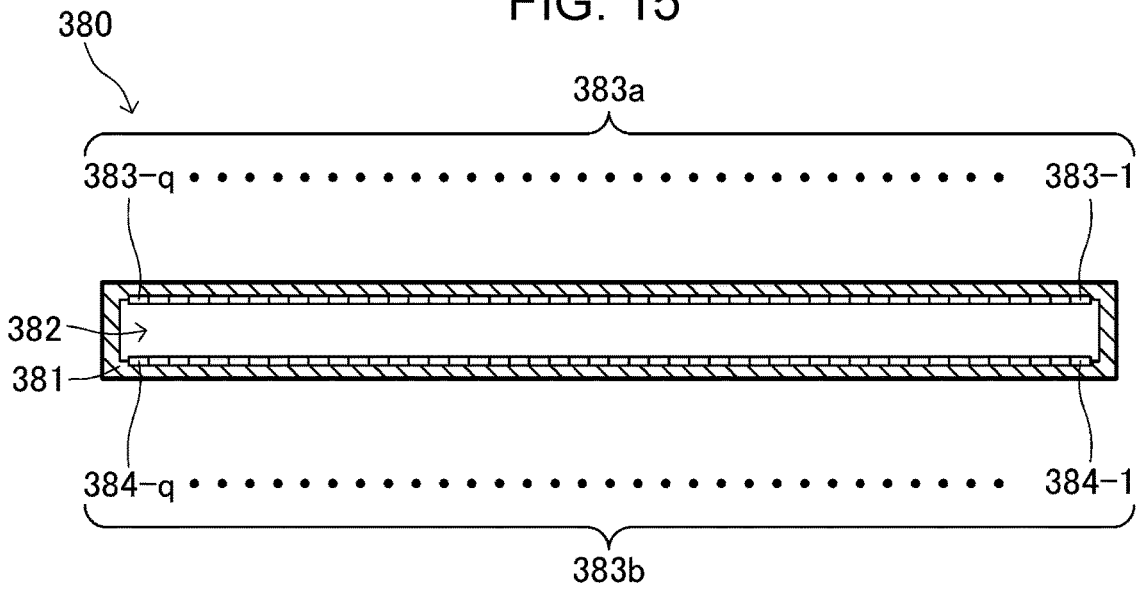
FIG. 15 is a diagram illustrating a configuration of a connector 380.

Here, a configuration of the connector 380 will be described with reference to FIG. 15. FIG. 15 is a diagram illustrating the configuration of the connector 380. As illustrated in FIG. 15, the connector 380 includes a housing 381, an attachment portion 382 formed in the housing 381, q pieces of terminals 383 arranged in the housing 381, and q pieces of terminals 384 arranged in the housing 381. Here, the q pieces of terminals 383 arranged in the connector 380 are referred to as terminals 383-1, 383-2, . . . , and 383-*q* in order from the right toward the left in FIG. 15. Similarly, the q pieces of terminals 384*b* arranged in the connector 380 are referred to as terminals 384-1, 384-2, . . . , and 384-*q* in order from the right toward the left in FIG. 15.

Returning to FIG. 14, details of the wiring of the above-described connector 380 in the head substrate 320 will be described. In the following descriptions, a housing 381 of a connector 380*a* in the connector 380 is referred to as a housing 381*a*. The attachment portion 382 is referred to as an attachment portion 382*a*. The q pieces of terminals 383 are referred to as q pieces of terminals 383*a*. The q pieces of terminals 384 are referred to as q pieces of terminals 384*a*. The q pieces of terminals 383*a* are referred to as terminals 383*a*-1 to 383*a*-*q*, respectively. The q pieces of terminals 384*a* are referred to as terminals 384*a*-1 to 384*a*-*q*. Similarly, a housing 381 of a connector 380*b* in the connector 380 is referred to as a housing 381*b*. The attachment portion 382 is referred to as an attachment portion 382*b*. The q pieces of terminals 383 are referred to as q pieces of terminals 383*b*. The q pieces of terminals 384 are referred to as q pieces of terminals 384*b*. The q pieces of terminals 383*b* are referred to as terminals 383*b*-1 to 383*b*-*q*, respectively. The q pieces of terminals 384*b* are referred to as terminals 384*b*-1 to 384*b*-*q*.

In the connector 380*a*, the q pieces of terminals 383*a* are provided on the side 324 side of the electrode groups 332*a* to 332*f* and 342*a* to 342*f* and the FPC insertion holes 331*a* to 331*f* and 341*a* to 341*f*, so as to be arranged from the side 326 toward the side 325 along the side 324 in order of the terminals 383*a*-1, 383*a*-2, . . . , and 383*a*-*q*. In the connector 380*b*, the q pieces of terminals 383*b* are provided on the side 323 side of the electrode groups 332*a* to 332*f* and 342*a* to 342*f* and the FPC insertion holes 331*a* to 331*f* and 341*a* to 341*f*, so as to be arranged from the side 325 toward the side 326 along the side 324 in order of the terminals 383*b*-1, 383*b*-2, . . . , and 383*b*-*q*. That is, the connector 380*a* and the connector 380*b* are provided on the head substrate 320 in a state of being rotated around the Z-direction by 180 degrees.

Next, a configuration of the relay substrate 330 will be described with reference to FIGS. 16 and 17. The relay substrate 330 is electrically coupled to the driving signal output circuits 50-1 to **50-*n*, the reference voltage signal output circuits 53-1 to 53-*n*, the first power source voltage output circuit 51, the second power source voltage output circuit 52, and the liquid discharge head 21, and relays propagation of a plurality of control signals including the driving signals COMA1 to COMAn and COMB1 to COMBn, the voltages VBS1 to VBSn, and the voltages VDD and VHV to the liquid discharge head 21. Here, the relay substrate 330** is an example of the circuit substrate.

Figure 16:
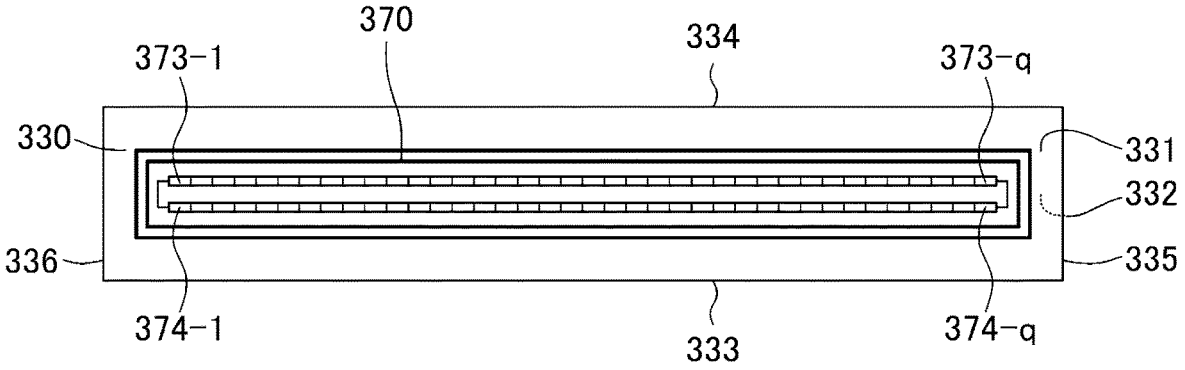
FIG. 16 is a plan view illustrating a configuration of a surface 331 of the relay substrate.
Figure 17:
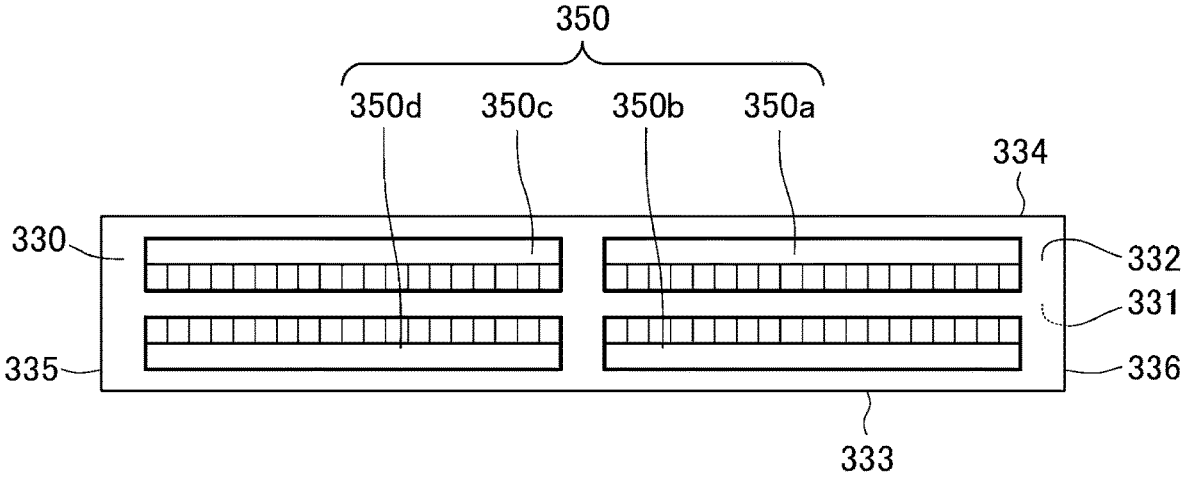
FIG. 17 is a plan view illustrating a configuration of the surface 332 of the relay substrate.

As illustrated in FIGS. 16 and 17, the relay substrate 330 has a surface 331 and a surface 332 different from the surface 331. The relay substrate 330 has a substantially rectangular shape formed by a side 333, a side 334 facing the side 333, a side 335, and a side 336 facing the side 335. The shape of the head substrate 320 is not limited to a rectangle. For example, the shape of the head substrate 320 may be a polygon such as a hexagon or an octagon, or may have a shape in which a notch or an arc is formed. Here, the surface 332 is an example of a first surface, and the surface 331 is an example of a second surface.

FIG. 16 is a plan view illustrating a configuration of the surface 331 of the relay substrate 330. As illustrated in FIG. 16, the connector 370 is provided on the surface 331 of the relay substrate 330. When the arrangement of the connector 370 in the relay substrate 330 is described, firstly, a configuration of the connector 370 will be described with reference to FIG. 18.

Figure 18:
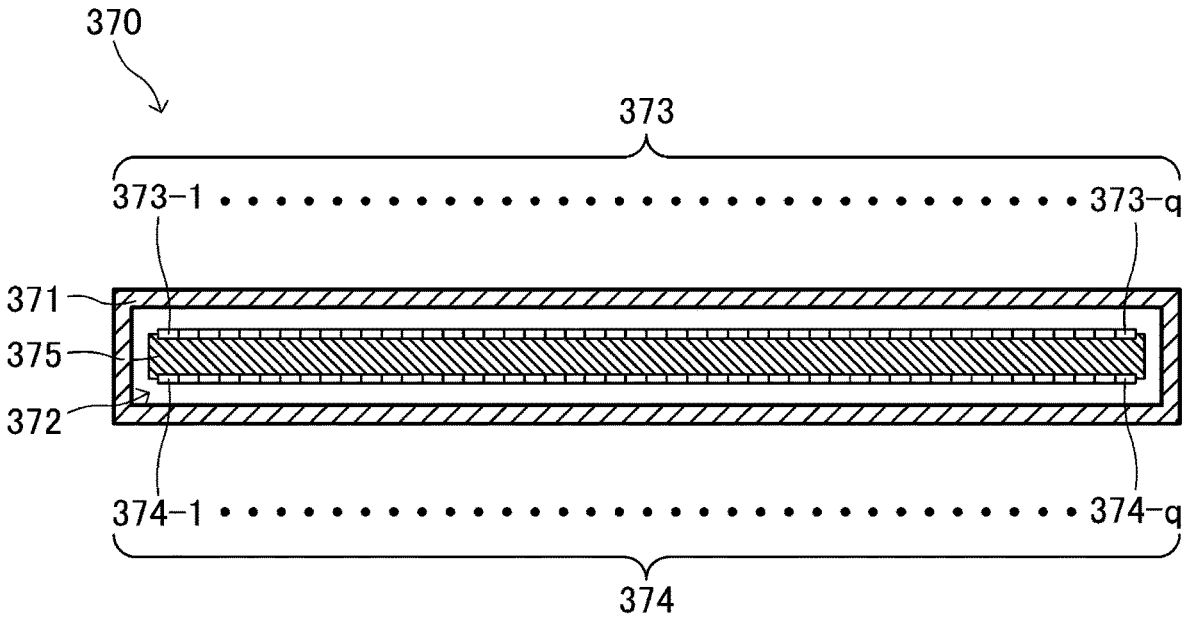
FIG. 18 is a diagram illustrating a configuration of a connector 370.

FIG. 18 is a diagram illustrating the configuration of the connector 370. As illustrated in FIG. 18, the connector 370 includes a housing 371, an attachment portion 372 provided in the housing 371, a terminal support portion 375, q pieces of terminals 373 arranged in the terminal support portion 375, and q pieces of terminals 374 arranged in the terminal support portion 375. Here, the q pieces of terminals 373 arranged in parallel in the connector 370 are referred to as terminals 373-1, 373-2, . . . , and **373-*q* in order from the left toward the right in FIG. 18. Similarly, the q pieces of terminals 374 arranged in parallel in the connector 370 are referred to as terminals 374-1, 374-2, . . . , and 374-*q* in order from the left toward the right in FIG. 18. In this case, the terminal 373-*k* (k is any of 1 to q) and the terminal 374-*k* are provided to face each other with the terminal support portion 375 interposed therebetween. Here, 2q pieces of terminals included in the connector 370 provided on the surface 331 of the relay substrate 330 is an example of a second terminal group. Each of the 2q pieces of terminals 373-1 to 373-*q* and 374-1 to 374-*q* included in the connector 370** is an example of a second terminal.

As illustrated in FIG. 16, in the relay substrate 330, in the connector 370 configured as described above, the q pieces of terminals 383 are provided to be arranged from the side 336 toward the side 335 along the side 334 in order of the terminals 373-1, 373-2, . . . , and **373-*q*. The connector 370 is fit with the connector 380 illustrated in FIG. 15. Thus, the q pieces of terminals 373 in the connector 370 are electrically coupled to the q pieces of terminals 383 in the connector 380, respectively. The q pieces of terminals 374 in the connector 370 are electrically coupled to the q pieces of terminals 384 in the connector 380, respectively. Accordingly, the relay substrate 330 and the head substrate 320 are electrically coupled to each other. In detail, the housing 381 of the connector 380 is inserted into the attachment portion 372 of the connector 370. The terminal support portion 375 of the connector 370 is inserted into the attachment portion 382 of the connector 380. In this case, the terminal 373-*k* is electrically coupled to the terminal 383-*k*, and the terminal 374-*k* is electrically coupled to the terminal 384-*k***.

FIG. 17 is a plan view illustrating a configuration of the surface 332 of the relay substrate 330. As illustrated in FIG. 17, the plurality of connectors 350 are provided on the surface 331 of the relay substrate 330. When the arrangement of the plurality of connectors 350 in the relay substrate 330 is described, firstly, a configuration of the connector 350 will be described with reference to FIG. 19.

Figure 19:
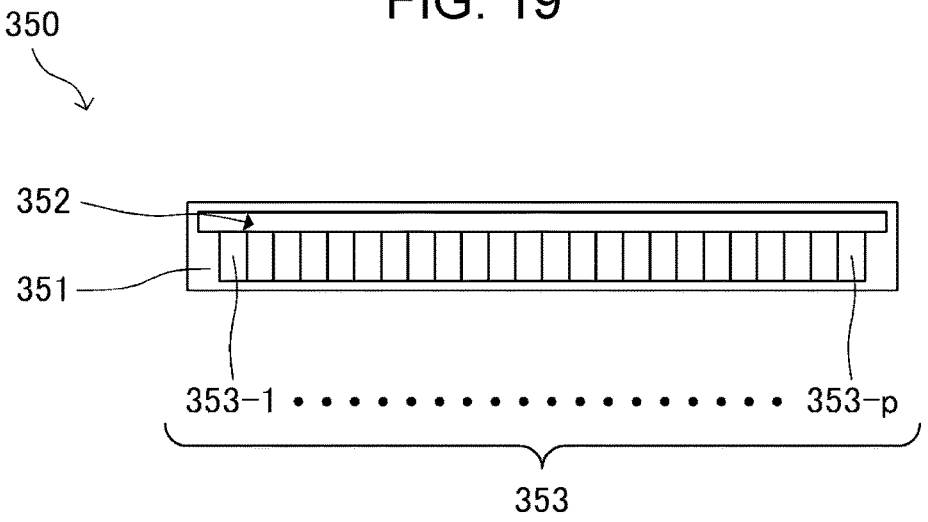
FIG. 19 is a diagram illustrating a configuration of a connector 350.

FIG. 19 is a diagram illustrating the configuration of the connector 350. As illustrated in FIG. 19, the connector 350 includes a housing 351, a cable attachment portion 352 formed in the housing 351, and p pieces of terminals 353 arranged in parallel in the housing 351. Here, the p pieces of terminals 353 arranged in parallel in the connector 350 are referred to as terminals 353-1, 353-2, . . . , and **353-*p* in order from the left toward the right in FIG. 19**.

The cable 19 is attached to the plurality of connectors 350 configured in a manner as described above. Specifically, the cable 19 is attached to the cable attachment portion 352 of the connector 350. In this case, the terminals 196-1 to **196-*p* of the cable 19 illustrated in FIG. 11 are electrically coupled to the terminal 353-1 to 353-*p* of the connector 350, respectively. Thus, various signals propagated in the wirings 197-1 to 197-*p* of the cable 19 are input to the relay substrate 330 through the connector 350**.

Returning to FIG. 17, four connectors **350*a* to 350*d* as the plurality of connectors 350 are provided on the relay substrate 330. In the following descriptions, the housing 351 in the connector 350*a* is referred to as a housing 351*a*, the cable attachment portion 352 is referred to as a cable attachment portion 352*a*, and the p pieces of terminals 353 are referred to as p pieces of terminals 353*a*. The p pieces of the terminals 353*a* are referred to as terminals 353*a*-1 to 353*a*-*p*. Similarly, the housings 351 in the connectors 350*b* to 350*d* are referred to as housings 351*b* to 351*d*. The cable attachment portions 352 are referred to as cable attachment portions 352*b* to 352*d*. The p pieces of terminals 353 are referred to as p pieces of terminals 353*b* to 353*d*. The p pieces of terminals 353*b* are referred to as terminals 353*b*-1 to 353*b*-*p*. The p pieces of terminals 353*c* are referred to as terminals 353*c*-1 to 353*c*-*p*. The p pieces of terminals 353*d* are referred to as terminals 353*d*-1 to 353*d*-*p***.

In the connector **350*a*, the p pieces of terminals 353*a* are provided to be arranged from the side 335 toward the side 336 along the side 334 in order of terminals 353*a*-1, 353*a*-2, . . . , 353*a*-*p*. In the connector 350*b*, the p pieces of terminals 353*b* are provided on the side 333 side of the connector 350*a* to be arranged from the side 336 toward the 335 along the side 333 in order of terminals 353*b*-1, 353*b*-2, . . . , and 353*b*-*p*. In the connector 350*c*, the p pieces of terminals 353*c* are provided on the side 335 side of the connector 350*a* to be arranged from the side 335 toward the 336 along the side 334 in order of terminals 353*c*-1, 353*c*-2, . . . , and 353*c*-*p*. In the connector 350*d*, the p pieces of terminals 353*d* are provided on the side 333 side of the connector 350*c* to be arranged from the side 336 toward the 335 along the side 333 in order of terminals 353*d*-1, 353*d*-2, . . . , and 353*d*-*p*. Here, 4p pieces of terminals included in the connectors 350*a* to 350*d* provided on the surface 332 of the relay substrate 330 is an example of a first terminal group. Each of the 4p pieces of terminals 353*a*-1 to 353*a*-*p*, 353*b*-1 to 353*b*-*p*, 353*c*-1 to 353*c*-*p*, and 353*d*-1 to 353*d*-*p* included in the connectors 350*a* to 350*d* is an example of a first terminal. Any of the connectors 350*a* to 350*d* provided on the surface 332 of the relay substrate 330 is an example of a first connector, and another of the connectors 350***a* to 350*d* is an example of a second connector.

Various signals for controlling the liquid discharge head 21 are supplied to the relay substrate 330 configured as described above, through the plurality of cables 19 which are respectively coupled to the connectors 350*a* to 350*d*. The various signals are propagated in a wiring pattern formed in the relay substrate 330, and then are supplied to the liquid discharge head 21 through the connector 360. Then, the various signals are supplied to the driving signal selection circuits 200-1 to 200-12 through FPCs coupled to the electrode groups 332*a* to 332*f* and 342*a* to 342*f*, respectively. Thus, the piezoelectric element 60 in each of the nozzle lines L1*a* to L1*f* and L2*a* to L2*f* drives and thus an ink having an amount depending on the driving of the piezoelectric element 60 is discharged from the nozzle 651.

In the connector 360 configured as described above, the connectors 370 and 380 that couple the relay substrate 330 and the liquid discharge head 21 to each other may be one set of BtoB connectors. In other words, the relay substrate 330 and the liquid discharge head 21 may be coupled to each other by one connector 360. Since the relay substrate 330 and the liquid discharge head 21 are coupled to each other by one connector 360, it is possible to more improve exchangeability of the liquid discharge head 21.

The total number of terminals 353*a*-1 to 353*a-p*, 353*b*-1 to 353*b-p*, 353*c*-1 to 353*c-p*, and 353*d*-1 to 353*d-p* included in the connectors 350*a* to 350*d* may be smaller than the total number of terminals 373-1 to 373-*q* and 374-1 to 374-*q* included in the connector 370. Thus, it is possible to reduce impedance of the connector 370 that couples the relay substrate 330 and the liquid discharge head 21 to each other and to reduce a concern that a signal propagated between the relay substrate 330 and the liquid discharge head 21 is distorted.

The shortest distance between the terminals 373-1 to 373-*q* and 374-1 to 374-*q* included in the connector 370 may be shorter than the shortest distance between the terminals 353*a*-1 to 353*a-p*, 353*b*-1 to 353*b-p*, 353*c*-1 to 353*c-p*, and 353*d*-1 to 353*d-p* included in the connectors 350*a* to 350*d*. Thus, even though the number of the terminals included in the connector 370 is set, it is possible to reduce a concern that the size of the relay substrate 330 increases.

Here, the integrated circuit constituting the restoration circuit 130 in the liquid discharge head 21 illustrated in FIG. 2 may be provided on the inside of the surface 322, the surface 321, and the head 310 of the head substrate 320, or may be mounted on an FPC in a manner of chip-on-film (COF). The integrated circuit constituting each of the driving signal selection circuits 200-1 to 200-6 may be provided in the head 310 or may be mounted on an FPC in a manner of COF.

6. Signal Propagated Between Liquid Discharge Head and Liquid Discharge Head Control Circuit Details of signals relayed by the relay substrate 330 which is electrically coupled to the liquid discharge head control circuit 15 and the liquid discharge head 21 in the liquid discharge apparatus 1 configured as described above will be described with reference to FIGS. 20 to 31. In the following descriptions, the relay substrate 330 coupled to the connector 380*a* provided on the head substrate 320 is referred to as a relay substrate 330*a*. The connector 370 provided on the relay substrate 330*a* is referred to as a connector 370*a*. The connectors 350*a* to 350*d* are referred to as connectors 350*a*1 to 350*d*1, respectively. The cables 19 coupled to the connectors 350*a*1 to 350*d*1 are referred to as cables 19*a*1 to 19*d*1, respectively. The wirings 197-1 to 197-*p* included in the cable 19*a*1 are referred to as wirings 197*a*1-1 to 197*a*1-*p*. The wirings 197-1 to 197-*p* included in the cable 19*b*1 are referred to as wiring 197*b*1-1 to 197*b*1-*p*. The wirings 197-1 to 197-*p* included in the cable 19*c*1 are referred to as wiring 197*c*1-1 to 197*c*1-*p*. The wirings 197-1 to 197-*p* included in the cable 19*d*1 are referred to as wiring 197*d*1-1 to 197*d*1-*p*.

Similarly, the relay substrate 330 coupled to the connector 380*b* provided on the head substrate 320 is referred to as a relay substrate 330*b*. The connector 370 provided on the relay substrate 330*b* is referred to as a connector 370*b*. The connectors 350*a* to 350*d* are referred to as connectors 350*a*2 to 350*d*2, respectively. The cables 19 coupled to the connectors 350*a*2 to 350*d*2 are referred to as cables 19*a*2 to 19*d*2, respectively. The wirings 197-1 to 197-*p* included in the cable 19*a*2 are referred to as wirings 197*a*2-1 to 197*a*2-*p*. The wirings 197-1 to 197-*p* included in the cable 19*b*2 are referred to as wiring 197*b*2-1 to 197*b*2-*p*. The wirings 197-1 to 197-*p* included in the cable 19*c*2 are referred to as wiring 197*c*2-1 to 197*c*2-*p*. The wirings 197-1 to 197-*p* included in the cable 19*d*2 are referred to as wiring 197*d*2-1 to 197*d*2-*p*.

In the following descriptions, descriptions will be made on the assumption that each of the plurality of cables 19 includes 24 wirings, and each of the plurality of connectors 350 includes 24 terminals 353. Descriptions will be made on the assumption that the connector 370 includes 80 terminals 373 and 80 terminals 374, and the connector 380 includes 80 terminals 373 and 80 terminals 384.

Details of signals relayed by the relay substrate 330*a* will be described with reference to FIGS. 20 to 25. FIG. 20 is a diagram illustrating details of the signal which is propagated in the cable 19*a*1 and is input to the relay substrate 330*a* through the connector 350*a*1. FIG. 21 is a diagram illustrating details of the signal which is propagated in the cable 19*b*1 and is input to the relay substrate 330*a* through the connector 350*b*1. FIG. 22 is a diagram illustrating details of the signal which is propagated in the cable 19*c*1 and is input to the relay substrate 330*a* through the connector 350*c*1. FIG. 23 is a diagram illustrating details of the signal which is propagated in the cable 19*d*1 and is input to the relay substrate 330*a* through the connector 350*d*1. FIG. 24 is diagram illustrating details of a low-voltage signal and a power source voltage signal among the signals which are relayed by the relay substrate 330*a* and are output to the liquid discharge head 21 through the connectors 370*a* and 380*a*. FIG. 25 is diagram illustrating details of the signal supplied to the piezoelectric element 60 among the signals which are relayed by the relay substrate 330*a* and are output to the liquid discharge head 21 through the connectors 370*a* and 380*a*.

As illustrated in FIGS. 22, 23, and 25, among the signals relayed by the relay substrate 330*a*, the driving signals COMA7 to COMA12 and COMB7 to COMB12 to be supplied to one end of the piezoelectric element 60 in the liquid discharge head 21 are propagated in the cable 19*c*1 and the cable 19*d*1 and then are output to the relay substrate 330*a* through the connectors 350*c*1 and 350*d*1. The driving signals COMA7 to COMA12 and COMB7 to COMB12 are input to the liquid discharge head 21 through the connector 370*a*.

Specifically, the driving signal COMA7 is propagated in the wirings 197*d*1-22 and 197*d*1-24 and is input to the relay substrate 330*a* through the terminals 353*d*1-22 and 353*d*1-24. The driving signal COMA7 is input to the liquid discharge head 21 through the terminals 374*a*-73, 374*a*-74, 374*a*-77, and 374*a*-78. The driving signal COMB7 is propagated in the wirings 197*c*1-2 and 197*c*1-4 and is input to the relay substrate 330*a* through the terminals 353*c*1-2 and 353c1-4. The driving signal COMB7 is input to the liquid discharge head 21 through the terminals 373a-71, 373a-72, 373a-75, and 373a-76.

The driving signal COMA8 is propagated in the wirings 197c1-6 and 197c1-8 and is input to the relay substrate 330a through the terminals 353c1-6 and 353c1-8. The driving signal COMA8 is input to the liquid discharge head 21 through the terminals 373a-63, 373a-64, 373a-67, and 373a-68. The driving signal COMB8 is propagated in the wirings 197d1-18 and 197d1-20 is input to the relay substrate 330a through the terminals 353d1-18 and 353d1-20. The driving signal COMB8 is input to the liquid discharge head 21 through the terminals 374a-65, 374a-66, 374a-69, and 374a-70.

The driving signal COMA9 is propagated in the wirings 197d1-14 and 197d1-16 is input to the relay substrate 330a through the terminals 353d1-14 and 353d1-16. The driving signal COMA9 is input to the liquid discharge head 21 through the terminals 374a-57, 374a-58, 374a-61, and 374a-62. The driving signal COMB9 is propagated in the wirings 197c1-10 and 197c1-12 and is input to the relay substrate 330a through the terminals 353c1-10 and 353c1-12. The driving signal COMB9 is input to the liquid discharge head 21 through the terminals 373a-55, 373a-56, 373a-59, and 373a-60.

The driving signal COMA10 is propagated in the wirings 197c1-14 and 197c1-16 and is input to the relay substrate 330a through the terminals 353c1-14 and 353c1-16.

The driving signal COMA10 is input to the liquid discharge head 21 through the terminals 373a-47, 373a-48, 373a-51, and 373a-52. The driving signal COMB10 is propagated in the wirings 197d1-10 and 197d1-12 and is input to the relay substrate 330a through the terminals 353d1-10 and 353d1-12. The driving signal COMB10 is input to the liquid discharge head 21 through the terminals 374a-49, 374a-50, 374a-53, and 374a-54.

The driving signal COMA11 is propagated in the wirings 197d1-6 and 197d1-8 and is input to the relay substrate 330a through the terminals 353d1-6 and 353d1-8. The driving signal COMA11 is input to the liquid discharge head 21 through the terminals 374a-41, 374a-42, 374a-45, and 374a-46. The driving signal COMB11 is propagated in the wirings 197c1-18 and 197c1-20 and is input to the relay substrate 330a through the terminals 353c1-18 and 353c1-20. The driving signal COMB11 is input to the liquid discharge head 21 through the terminals 373a-39, 373a-40, 373a-43, and 373a-44.

The driving signal COMA12 is propagated in the wirings 197c1-22 and 197c1-24 and is input to the relay substrate 330a through the terminals 353c1-22 and 353c1-24. The driving signal COMA12 is input to the liquid discharge head 21 through the terminals 373a-31, 373a-32, 373a-35, and 373a-36. The driving signal COMB12 is propagated in the wirings 197d1-2 and 197d1-4 is input to the relay substrate 330a through the terminals 353d1-2 and 353d1-4. The driving signal COMB12 is input to the liquid discharge head 21 through the terminals 374a-33, 374a-34, 374a-37, and 374a-38.

As described above, the total number of terminals included in the plurality of connectors 350a1 to 350d1 provided on the surface 332 on which each of the driving signals COMA7 to COMA12 and COMB7 to COMB12 is input to the relay substrate 330a is smaller than the total number of terminals included in the connector 370a provided on the surface 331 on which each of the driving signals COMA7 to COMA12 and COMB7 to COMB12 is output from the relay substrate 330a.

As illustrated in FIGS. 22, 23, and 25, among the signals relayed by the relay substrate 330a, the voltages VBS7 to VBS12 to be supplied to the other end of the piezoelectric element 60 in the liquid discharge head 21 are propagated in the cable 19c1 and the cable 19d1 and then are output to the relay substrate 330a through the connectors 350c1 and 350d1. The voltages VBS7 to VBS12 are input to the liquid discharge head 21 through the connector 370a.

Specifically, the voltage VBS7 is propagated in the wirings 197c1-1, 197c1-3, 197d1-21, and 197d1-23 and is input to the relay substrate 330a through the terminals 353c1-1, 353c1-3, 353d1-21, and 353d1-23. The voltage VBS7 is input to the liquid discharge head 21 through the terminals 373a-73, 373a-74, 373a-77, 373a-78, 374a-71, 373a-72, 373a-75, and 373a-76.

The voltage VBS8 is propagated in the wirings 197c1-5, 197c1-7, 197d1-17, and 197d1-19 and is input to the relay substrate 330a through the terminals 353c1-5, 353c1-7, 353d1-17, and 353d1-19. The voltage VBS8 is input to the liquid discharge head 21 through the terminals 373a-65, 373a-66, 373a-69, 373a-70, 374a-63, 373a-64, 373a-67, and 373a-68.

The voltage VBS9 is propagated in the wirings 197c1-9, 197c1-11, 197d1-13, and 197d1-15 and is input to the relay substrate 330a through the terminals 353c1-9, 353c1-11, 353d1-13, and 353d1-15. The voltage VBS9 is input to the liquid discharge head 21 through the terminals 373a-57, 373a-58, 373a-61, 373a-62, 374a-55, 373a-56, 373a-59, and 373a-60.

The voltage VBS10 is propagated in the wirings 197c1-13, 197c1-15, 197d1-9, and 197d1-11 and is input to the relay substrate 330a through the terminals 353c1-13, 353c1-15, 353d1-9, and 353d1-11. The voltage VBS10 is input to the liquid discharge head 21 through the terminals 373a-49, 373a-50, 373a-53, 373a-54, 374a-47, 373a-48, 373a-51, and 373a-52.

The voltage VBS11 is propagated in the wirings 197c1-17, 197c1-19, 197d1-5, and 197d1-9 and is input to the relay substrate 330a through the terminals 353c1-17, 353c1-19, 353d1-5, and 353d1-9. The voltage VBS11 is input to the liquid discharge head 21 through the terminals 373a-41, 373a-42, 373a-45, 373a-46, 374a-39, 373a-40, 373a-43, and 373a-44.

The voltage VBS12 is propagated in the wirings 197c1-21, 197c1-23, 197d1-1, and 197d1-3 and is input to the relay substrate 330a through the terminals 353c1-21, 353c1-23, 353d1-1, and 353d1-3. The voltage VBS12 is input to the liquid discharge head 21 through the terminals 373a-33, 373a-34, 373a-37, 373a-38, 374a-31, 373a-32, 373a-35, and 373a-36.

As described above, the number of terminals included in the plurality of connectors 350a1 to 350d1 provided on the surface 332 on which each of the voltages VBS7 to VBS12 is input to the relay substrate 330a is smaller than the number of terminals included in the connector 370a provided on the surface 331 on which each of the voltages VBS7 to VBS12 is output from the relay substrate 330a.

As illustrated in FIGS. 20 and 24, among the signals propagated by the relay substrate 330a, the voltage VDD used as a voltage power source of the driving signal selection circuits 200-1 to 200-12 is propagated in the cable 19a1 and is input to the relay substrate 330a through the connector 350a1. The voltage VDD is input to the liquid discharge head 21 through the connector 370a.

Specifically, the voltage VDD is propagated in the wirings 197a1-20 to 197a1-23 and is input to the relay substrate 330a through the terminals 353a1-20 to 353a1-23. The voltage VDD is input to the liquid discharge head 21 through the terminals 373*a*-2 to 373*a*-8 and 374*a*-1 to 374*a*-8. That is, the total number of terminals included in the plurality of connectors 350*a*1 to 350*d*1 provided on the surface 332 on which the voltage VDD is input to the relay substrate 330*a* is smaller than the total number of terminals included in the connector 370*a* provided on the surface 331 on which the voltage VDD is output from the relay substrate 330*a*.

As illustrated in FIGS. 20 and 24, among the signals propagated by the relay substrate 330*a*, the voltage VHV used as an operation voltage for operating the selection circuit 230 is propagated in the cable 19*a*1 and is input to the relay substrate 330*a* through the connector 350*a*1. The voltage VHV is input to the liquid discharge head 21 through the connector 370*a*.

Specifically, the voltage VHV is propagated in the wiring 197*a*1-1 and is input to the relay substrate 330*a* through the terminal 353*a*1-1. The voltage VHV is input to the liquid discharge head 21 through the terminals 373*a*-28, 373*a*-29, 374*a*-28, and 374*a*-29. That is, the total number of terminals included in the plurality of connectors 350*a*1 to 350*d*1 provided on the surface 332 on which the voltage VHV is input to the relay substrate 330*a* is smaller than the total number of terminals included in the connector 370*a* provided on the surface 331 on which the voltage VHV is output from the relay substrate 330*a*.

In this case, a difference between the total number of terminals included in the plurality of connectors 350*a*1 to 350*d*1 provided on the surface 332 on which the voltage VHV is input to the relay substrate 330*a* and the total number of terminals included in the connector 370*a* provided on the surface 331 on which the voltage VHV is output from the relay substrate 330*a* is smaller than a difference between the total number of terminals included in the plurality of connectors 350*a*1 to 350*d*1 provided on the surface 332 on which the voltage VDD is input to the relay substrate 330*a* and the total number of terminals included in the connector 370*a* provided on the surface 331 on which the voltage VDD is output from the relay substrate 330*a*.

As illustrated in FIGS. 21 and 24, among the signals relayed by the relay substrate 330*a*, the pair of differential clock signals dSCK being the base of the clock signal SCK, the pair of differential print data signals dSI1 to dSI6 being the bases of the print data signals SI1 to SI6, the base latch signal oLAT being the base of the latch signal LAT, and the base change signals oCHa and oCHb being the bases of the change signals CHa and CHb, which are used for controlling the supply of the driving signals COMA1 to COMA6 and COMB1 to COMB6 to the piezoelectric element 60 in the driving signal selection circuits 200-1 to 200-6 are propagated in the cable 19*b*1 and are input to the relay substrate 330*a* through the connector 350*b*1. Each of the differential clock signal dSCK, the differential print data signals dSI1 to dSI6, the base latch signal oLAT, and the base change signals oCHa and oCHb is input to the liquid discharge head 21 through the connector 370*a*.

Specifically, one signal dSCK+ of the pair of differential clock signals dSCK is propagated in the wiring 197*b*1-4 and is input to the relay substrate 330*a* through the terminal 353*b*1-4. The signal dSCK+ is input to the liquid discharge head 21 through the terminal 374*a*-10. The other signal dSCK− of the pair of differential clock signals dSCK is propagated in the wiring 197*b*1-5 and is input to the relay substrate 330*a* through the terminal 353*b*1-5. The signal dSCK− is input to the liquid discharge head 21 through the terminal 374*a*-11.

One signal dSI1+ of the pair of differential print data signals dSI1 is propagated in the wiring 197*b*1-7 and is input to the relay substrate 330*a* through the terminal 353*b*1-7. The signal dSI1+ is input to the liquid discharge head 21 through the terminal 374*a*-13. The other signal dSI2− of the pair of differential print data signals dSI2 is propagated in the wiring 197*b*1-8 and is input to the relay substrate 330*a* through the terminal 353*b*1-8. The signal dSI2− is input to the liquid discharge head 21 through the terminal 374*a*-14.

One signal dSI2+ of the pair of differential print data signals dSI2 is propagated in the wiring 197*b*1-9 and is input to the relay substrate 330*a* through the terminal 353*b*1-9. The signal dSI2+ is input to the liquid discharge head 21 through the terminal 373*a*-14. The other signal dSI2− of the pair of differential print data signals dSI2 is propagated in the wiring 197*b*1-10 and is input to the relay substrate 330*a* through the terminal 353*b*1-10. The signal dSI2− is input to the liquid discharge head 21 through the terminal 373*a*-15.

One signal dSI3+ of the pair of differential print data signals dSI3 is propagated in the wiring 197*b*1-11 and is input to the relay substrate 330*a* through the terminal 353*b*1-11. The signal dSI3+ is input to the liquid discharge head 21 through the terminal 374*a*-16. The other signal dSI3− of the pair of differential print data signals dSI3 is propagated in the wiring 197*b*1-12 and is input to the relay substrate 330*a* through the terminal 353*b*1-12. The signal dSI3− is input to the liquid discharge head 21 through the terminal 374*a*-17.

One signal dSI4+ of the pair of differential print data signals dSI4 is propagated in the wiring 197*b*1-13 and is input to the relay substrate 330*a* through the terminal 353*b*1-13. The signal dSI4+ is input to the liquid discharge head 21 through the terminal 373*a*-17. The other signal dSI4− of the pair of differential print data signals dSI4 is propagated in the wiring 197*b*1-14 and is input to the relay substrate 330*a* through the terminal 353*b*1-14. The signal dSI4− is input to the liquid discharge head 21 through the terminal 373*a*-18.

One signal dSI5+ of the pair of differential print data signals dSI5 is propagated in the wiring 197*b*1-15 and is input to the relay substrate 330*a* through the terminal 353*b*1-15. The signal dSI5+ is input to the liquid discharge head 21 through the terminal 374*a*-19. The other signal dSI5− of the pair of differential print data signals dSI5 is propagated in the wiring 197*b*1-16 and is input to the relay substrate 330*a* through the terminal 353*b*1-16. The signal dSI5− is input to the liquid discharge head 21 through the terminal 374*a*-20.

One signal dSI6+ of the pair of differential print data signals dSI6 is propagated in the wiring 197*b*1-17 and is input to the relay substrate 330*a* through the terminal 353*b*1-17. The signal dSI6+ is input to the liquid discharge head 21 through the terminal 373*a*-20. The other signal dSI6− of the pair of differential print data signals dSI6 is propagated in the wiring 197*b*1-18 and is input to the relay substrate 330*a* through the terminal 353*b*1-18. The signal dSI6− is input to the liquid discharge head 21 through the terminal 373*a*-21.

The base latch signal oLAT is propagated in the wiring 197*b*1-20 and is input to the relay substrate 330*a* through the terminal 353*b*1-20. The base latch signal oLAT is input to the liquid discharge head 21 through the terminal 373*a*-10. The base change signal oCHa is propagated in the wiring 197*b*1-22 and is input to the relay substrate 330*a* through the terminal 353*b*1-22. The base change signal oCHa is input to the liquid discharge head 21 through the terminal 374*a*1-24. The base change signal oCHb is propagated in the wiring 197*b*1-23 and is input to the relay substrate 330*a* through the terminal 353*b*1-23. The base change signal oCHb is input to the liquid discharge head 21 through the terminal 373*a*1-24.

As illustrated in FIGS. 20, 21, and 24, among the signals relayed by the relay substrate 330*a*, the ground signal GND1 which has a ground potential and is input to the driving signal selection circuits 200-1 to 200-12 and the ground signal GND2 which has a ground potential and is input to the restoration circuit 130 are propagated in the cable 19*b*1 and are input to the relay substrate 330*a* through the connector 350*b*1. Each of the ground signals GND1 and GND2 is input to the liquid discharge head 21 through the connector 370*a*.

The ground signal GND1 is propagated in the wirings 197*a*1-2, 197*a*1-4 to 197*a*1-19, 197*b*1-19, and 197*b*1-21 and is input to the relay substrate 330*a* through the terminals 353*a*1-2, 353*a*1-4 to 353*a*1-19, 353*b*1-19, and 353*b*1-21. The ground signal GND1 is input to the liquid discharge head 21 through the terminals 373*a*-9, 373*a*-11, 373*a*-23, 373*a*-25, 373*a*-27, 374*a*-23, 374*a*-25, 374*a*-27, and 374*a*-30. The ground signal GND2 is propagated in the wirings 197*b*1-3 and 197*b*1-6 and is input to the relay substrate 330*a* through the terminals 353*b*1-3 and 353*b*1-6. The ground signal GND2 is input to the liquid discharge head 21 through the terminals 373*a*-13, 373*a*-16, 373*a*-19, 373*a*-22, 374*a*-9, 374*a*-12, 374*a*-15, 374*a*-18, and 374*a*-21.

As described above, in the plurality of connectors 350 provided on the surface 332 of the relay substrate 330*a*, the terminal 353*b*1-7 to which the one signal dSI1+ in the differential print data signal dSI1 is input and the terminal 353*b*1-11 to which the one signal dSI3+ in the differential print data signal dSI3 is input are disposed to be arranged in parallel. In the plurality of connectors 350, the terminal to which the ground signal GND2 to be input to the restoration circuit 130 is input is not located in a direction in which the terminal 353*b*1-7 and the terminal 353*b*-11 are arranged in parallel.

On the contrary, in the plurality of connectors 370*a* provided on the surface 321 of the relay substrate 330*a*, the terminal 374*a*-13 to which the one signal dSI1+ in the differential print data signal dSI1 is output and the terminal 374*a*-16 to which the one signal dSI3+ in the differential print data signal dSI3 is output are disposed to be arranged in parallel. In the connector 370*a*, the terminal 374*a*-15 to which the ground signal GND2 to be input to the restoration circuit 130 is input is located in a direction in which the terminal 374*a*-13 and the terminal 374*a*-16 are arranged.

As described above, in the plurality of connectors 350 provided on the surface 332 of the relay substrate 330*a*, the terminal 353*b*1-22 to which the base change signal oCHa is input and the terminal 353*b*1-23 to which the base change signal oCHb is input are disposed to be arranged in parallel. In the plurality of connectors 350, the terminal to which the ground signal GND1 to be input to the driving signal selection circuits 200-1 to 200-12 is input is not located in a direction in which the terminal 353*b*1-22 and the terminal 353*b*-23 are arranged.

On the contrary, in the plurality of connectors 370*a* provided on the surface 321 of the relay substrate 330*a*, the terminal 374*a*-24 to which the base change signal oCHa is output and the terminal 374*a*-22 to which the base change signal oCHb is output are disposed to be arranged in parallel. In the connector 370*a*, the terminal 374*a*-23 to which the ground signal GND1 to be input to the driving signal selection circuits 200-1 to 200-12 is input is located in a direction in which the terminal 374*a*-24 and the terminal 374*a*-22 are arranged.

As illustrated in FIGS. 20 to 25, the cables 19*a*1 to 19*d*1, the connectors 350*a*1, 350*b*1, 350*c*1, and 350*d*1, and the connector 370*a* are used for propagating a plurality of control signals such as a signal NVTS, a signal TSIG, a signal NCHG, a signal XHOT, and a signal TH. The signal NVTS is used to detect a discharge state of the ink from the liquid discharge head 21. The signal TSIG is used to define a detection timing of the discharge state of the ink by the signal NVTS. The signal NCHG is used to forcibly drive a plurality of piezoelectric elements 60 in the liquid discharge head 21. The signal XHOT indicates temperature abnormality of the liquid discharge head 21. The signal TH indicates temperature information of the liquid discharge head 21. The plurality of control signals such as the signals NVTS, TSIG, NCHG, XHOT, and TH are relayed by the relay substrate 330*a* and are propagated between the liquid discharge head control circuit 15 and the liquid discharge head 21.

Next, the signals relayed by the relay substrate 330*b* will be described with reference to FIGS. 26 to 31. FIG. 26 is a diagram illustrating details of the signal which is propagated in the cable 19*a*2 and is input to the relay substrate 330*b* through the connector 350*a*2. FIG. 27 is a diagram illustrating details of the signal which is propagated in the cable 19*b*2 and is input to the relay substrate 330*b* through the connector 350*b*2. FIG. 28 is a diagram illustrating details of the signal which is propagated in the cable 19*c*2 and is input to the relay substrate 330*b* through the connector 350*c*2. FIG. 29 is a diagram illustrating details of the signal which is propagated in the cable 19*d*2 and is input to the relay substrate 330*b* through the connector 350*d*2. FIG. 30 is a diagram illustrating details of a low-voltage signal and the power source voltage signal among the signals which are relayed by the relay substrate 330*b* and are output to the liquid discharge head 21 through the connectors 370*b* and 380*b*. FIG. 31 is a diagram illustrating details of the signal to be supplied to the piezoelectric element 60 among the signals which are relayed by the relay substrate 330*b* and are output to the liquid discharge head 21 through the connectors 370*b* and 380*b*.

As illustrated in FIGS. 26 to 31, the signal relayed by the relay substrate 330*b* is similar to the signal relayed by the above-described relay substrate 330*a*. The signal input to the terminal of each of the connectors 350*a*2, 350*b*2, 350*c*2, and 350*d*2 provided on the relay substrate 330*b* is similar to the signal input to the terminal of each of the connectors 350*a*1, 350*b*1, 350*c*1, and 350*d*1 provided on the relay substrate 330*a*. The signal input to the terminal of each of the connectors 370*b* and 380*b* provided on the relay substrate 330*b* is similar to the signal input to the terminal of each of the connectors 370*a* and 380*a* provided on the relay substrate 330*a*. Thus, the detailed descriptions of the signal relayed by the relay substrate 330*b* will be omitted.

The connector 350*a*2 to 350*d*2 provided on the relay substrate 330*b* correspond to the connectors 350*a*1 to 350*d*1 provided on the relay substrate 330*a*, respectively. The connectors 370*b* and 380*b* provided on the relay substrate 330*b* correspond to the connectors 370*a* and 380*a* provided on the relay substrate 330*a*, respectively. The cable 19*a*2 to 19*d*2 coupled to the connector 350*a*2 to 350*d*2 provided on the relay substrate 330*b* correspond to the cables 19*a*1 to 19*d*1 coupled to the connectors 350*a*1 to 350*d*1 provided on the relay substrate 330*a*, respectively. The differential print data signals dSI7 to dSI12 among the signals relayed by the relay substrate 330*b* correspond to the differential print data signals dSI1 to dSI6 among the signals relayed by the relay substrate 330*a*, respectively. The driving signals COMA1 to COMA6 and COMB1 to COMB6 and the voltages VBS1 to VBS6 among the signals relayed by the relay substrate 330*b* correspond to the driving signals COMA7 to COMA12 and COMB7 to COMB12 and the voltages VBS7 to VBS12 among the signals relayed by the relay substrate 330*a*, respectively.

7. Advantageous Effects

In the liquid discharge apparatus 1 and the relay substrate 330 described above, on the surface 332 of the relay substrate 330, the driving signals COMA1 to COMA12 input through the connectors 350*a* to 350*b* are output to the liquid discharge head 21 through the connector 370 provided on the surface 331 of the relay substrate 330. In this case, the number of terminals which are provided in the connectors 350*a* to 350*b* and to which the driving signals COMA1 to COMA12 is smaller than the number of terminals which are provided in the connector 370 and to which the driving signals COMA1 to COMA12 are output. That is, the driving signals COMA1 to COMA12 are branched in the relay substrate 330, and then are output to the liquid discharge head 21 through more terminals. Thus, an amount of a current flowing in the terminals in which the driving signals COMA1 to COMA12 are propagated through the connector 370 is reduced. Accordingly, an inductance component occurring in the terminals in which the driving signals COMA1 to COMA12 are propagated through the connector 370 is reduced. As a result, a concern that the waveforms of the driving signals COMA1 to COMA12 to be input to the liquid discharge head 21 are distorted by the inductance component is reduced.

In the liquid discharge apparatus 1 and the relay substrate 330 described above, on the surface 332 of the relay substrate 330, the voltages VBS1 to VBS12 and the voltages VDD and VHV input through the connectors 350*a* to 350*b* are output to the liquid discharge head 21 through the connector 370 provided on the surface 331 of the relay substrate 330. In this case, the number of terminals which are provided in the connectors 350*a* to 350*b* and to which the voltages VBS1 to VBS12 and the voltages VDD and VHV is smaller than the number of terminals which are provided in the connector 370 and to which the voltages VBS1 to VBS12 and the voltages VDD and VHV are output. That is, the voltages VBS1 to VBS12 and the voltages VDD and VHV are branched in the relay substrate 330, and then are output to the liquid discharge head 21 through more terminals. Thus, an amount of a current flowing in the terminals in which the voltages VBS1 to VBS12 and the voltages VDD and VHV are propagated through the connector 370 is reduced. Accordingly, the degree of voltage drop occurring in the terminals in which the voltages VBS1 to VBS12 and the voltages VDD and VHV are propagated through the connector 370 is reduced. As a result, a concern that the waveforms of the voltages VBS1 to VBS12 and the voltages VDD and VHV input to the liquid discharge head 21 are distorted is reduced.

Further, in this case, a difference between the total number of terminals provided in the connectors 350*a* to 350*d* to which the VHV is input and the total number of terminals provided in the connector 370*a* to which the voltage VHV is output is smaller than a difference between the total number of terminals provided in the connectors 350*a* to 350*d* to which the voltage VDD is input and the total number of terminals provided in the connector 370*a* to which the voltage VDD is output. That is, in the relay substrate 330, the voltage VDD is branched into more terminals than those for the voltage VHV. Since the voltage value of the voltage VDD is smaller than the voltage value of the voltage VHV, it is possible to reduce an influence of voltage drop occurring in the voltage VDD by branching the voltage VDD into more terminals.

Hitherto, the embodiments and the modification examples are described. However, the present disclosure is not limited to the above embodiments, and various forms can be made in a range without departing from the gist. For example, the embodiments may be appropriately combined.

The present disclosure includes the substantially same configurations (for example, configurations having the same functions, methods, and results, or configurations having the same objects and effects) as the configurations described in the embodiments. The present disclosure includes configurations in which non-essential components of the configurations described in the embodiments are replaced. The present disclosure includes configurations having the same advantageous effects as those of the configurations described in the embodiments or includes configurations capable of achieving the same object. The present disclosure includes configurations in which a known technique is added to the configurations described in the embodiments.

What is claimed is:

1. A liquid discharge apparatus comprising:

a liquid discharge head that includes a driving element that drives by supplying a driving signal and discharges a liquid from a nozzle by driving of the driving element;

a driving signal output circuit that outputs the driving signal; and a circuit substrate that is electrically coupled to the driving signal output circuit and the liquid discharge head and relays propagation of a plurality of control signals including the driving signal to the liquid discharge head, wherein the circuit substrate includes a first surface, a second surface different from the first surface, a first terminal group, and a second terminal group, the first terminal group includes a plurality of first terminals and is provided on the first surface, the second terminal group includes a plurality of second terminals and is provided on the second surface, and the number of the first terminals which are electrically coupled to the driving signal output circuit and to which the driving signal is input is smaller than the number of the second terminals which are electrically coupled to the liquid discharge head and from which the driving signal is output.

2. The liquid discharge apparatus according to claim 1, wherein, the driving signal is supplied to one end of the driving element, and a reference voltage signal is supplied to the other end of the driving element, the liquid discharge apparatus further includes a reference voltage signal output circuit that outputs the reference voltage signal, the circuit substrate is electrically coupled to the reference voltage signal output circuit and relays propagation of the reference voltage signal as the plurality of control signals to the liquid discharge head, and the number of the first terminals which are electrically coupled to the reference voltage signal output circuit and to which the reference voltage signal is input is smaller than the number of the second terminals which are electrically coupled to the liquid discharge head and from which the reference voltage signal is output.

3. The liquid discharge apparatus according to claim 1, wherein the liquid discharge head includes a driving signal selection circuit that includes a switch circuit and controls a supply of the driving signal to the driving element by an operation of the switch circuit, a first power source voltage output circuit that outputs a first voltage signal to be used as a power source voltage of the driving signal selection circuit is provided, the circuit substrate is electrically coupled to the first power source voltage output circuit and relays propagation of the first voltage signal as the plurality of control signals to the liquid discharge head, and the number of the first terminals which are electrically coupled to the first power source voltage output circuit and to which the first voltage signal is input is smaller than the number of the second terminals which are electrically coupled to the liquid discharge head and from which the first voltage signal is output.

4. The liquid discharge apparatus according to claim 3, further comprising:

a second power source voltage output circuit that outputs a second voltage signal to be used as an operation voltage for operating the switch circuit, wherein the circuit substrate is electrically coupled to the second power source voltage output circuit and relays propagation of the second voltage signal as the plurality of control signals to the liquid discharge head, a voltage value of the second voltage signal is larger than a voltage value of the first voltage signal, the number of the first terminals which are electrically coupled to the second power source voltage output circuit and to which the second voltage signal is input is smaller than the number of the second terminals which are electrically coupled to the liquid discharge head and from which the second voltage signal is output, and a difference between the number of the first terminals to which the second voltage signal is input and the number of the second terminals from which the second voltage signal is output is smaller than a difference between the number of the first terminals to which the first voltage signal is input and the number of the second terminals from which the first voltage signal is output.

5. The liquid discharge apparatus according to claim 1, wherein the number of the plurality of the first terminals included in the first terminal group is smaller than the number of the plurality of the second terminals included in the second terminal group.

6. The liquid discharge apparatus according to claim 1, wherein the first terminal group includes a first connector and a second connector.

7. The liquid discharge apparatus according to claim 1, wherein a shortest distance between the plurality of the second terminals is shorter than a shortest distance between the plurality of the first terminals.

8. A circuit substrate that includes a driving element that drives by supplying a driving signal, is electrically coupled to a liquid discharge head that discharges a liquid from a nozzle by driving the driving element and a driving signal output circuit that outputs the driving signal, and relays propagation of a plurality of control signals including the driving signal to the liquid discharge head, the circuit substrate comprising:

a first surface;

a second surface different from the first surface;

a first terminal group; and a second terminal group, wherein the first terminal group includes a plurality of first terminals and is provided on the first surface, the second terminal group includes a plurality of second terminals and is provided on the second surface, and the number of the first terminals which are electrically coupled to the driving signal output circuit and to which the driving signal is input is smaller than the number of the second terminals which are electrically coupled to the liquid discharge head and from which the driving signal is output.

* * * * *